US010357114B2

(12) United States Patent
Wilkinson

(10) Patent No.: US 10,357,114 B2
(45) Date of Patent: Jul. 23, 2019

(54) INFLATABLE CUSHIONING DEVICE WITH MANIFOLD SYSTEM

(75) Inventor: John Wilkinson, Lady Lake, FL (US)

(73) Assignee: WCW, INC., Manchester, VT (US)

( * ) Notice: Subject to any disclaimer, the term of this patent is extended or adjusted under 35 U.S.C. 154(b) by 2003 days.

(21) Appl. No.: 11/041,758

(22) Filed: Jan. 24, 2005

(65) Prior Publication Data

US 2005/0125905 A1 Jun. 16, 2005

Related U.S. Application Data

(60) Continuation-in-part of application No. 10/404,962, filed on Mar. 31, 2003, now Pat. No. 8,122,545, which is a continuation of application No. 09/867,308, filed on May 29, 2001, now Pat. No. 6,826,795, which is a division of application No. 09/295,139, filed on Apr. 20, 1999, now Pat. No. 6,269,505.

(60) Provisional application No. 60/544,366, filed on Feb. 13, 2004.

(51) Int. Cl.

| | |
|---|---|
| ***A47C 27/10*** | (2006.01) |
| ***A47C 27/08*** | (2006.01) |
| ***A47C 27/18*** | (2006.01) |
| ***A61G 7/057*** | (2006.01) |

(52) U.S. Cl.

CPC ..... *A47C 27/083* (2013.01); *A47C 27/082* (2013.01); *A47C 27/084* (2013.01); *A47C 27/088* (2013.01); *A47C 27/10* (2013.01); *A47C 27/18* (2013.01); *A61G 7/05769* (2013.01); *A61G 7/05776* (2013.01)

(58) Field of Classification Search

CPC ..... A47C 27/10

USPC ..... 5/706, 654, 709–710, 713, 655.3; 92/34–47; 417/472–473

See application file for complete search history.

(56) References Cited

U.S. PATENT DOCUMENTS

| | | | |
|---|---|---|---|
| 201,728 | A | 3/1878 | White |
| 786,930 | A | 4/1905 | Wiltsie |
| 2,245,909 | A | 6/1941 | Enfiajian |

(Continued)

FOREIGN PATENT DOCUMENTS

| | | | |
|---|---|---|---|
| CN | 1500989 | A | 6/2004 |
| DE | 3642508 | A1 | 6/1998 |

(Continued)

OTHER PUBLICATIONS

Office Action (dated Jul. 20, 2010) for U.S. Appl. No. 11/841,047, filed Aug. 20, 2007.

(Continued)

*Primary Examiner* — Frederick C Conley

(74) *Attorney, Agent, or Firm* — Schmeiser, Olsen & Watts, LLP

(57) ABSTRACT

A cushioning device for a body support such as a mattress, seat, sofa, or the like where support is obtained from a fluid in fluid cells having a spring bias. The cushioning device is self-inflating, self-adjusting, and provides a low interface pressure under the entire contact surface of a patient. Shear force scraping damage is prevented by a sleeve apparatus. A support system apparatus provides separately adjustable pressure support zones. For physical therapy, an alternating pressure system provides alternating lifting and lowering pressure zones under a patient.

4 Claims, 20 Drawing Sheets

(56) References Cited

U.S. PATENT DOCUMENTS

| | | | | |
|---|---|---|---|---|
| 2,433,012 | A | | 12/1947 | Zalicovitz |
| 2,750,606 | A | | 6/1956 | Freedlander et al. |
| 2,779,034 | A | * | 1/1957 | Arpin ..... 5/697 |
| 3,192,540 | A | | 7/1965 | Swank |
| 3,251,077 | A | | 5/1966 | Beckman |
| 3,263,247 | A | | 8/1966 | Knittel et al. |
| 3,357,515 | A | | 12/1967 | Richards |
| 3,390,674 | A | | 7/1968 | Jones |
| 3,462,778 | A | | 8/1969 | Whitney |
| 3,633,228 | A | | 1/1972 | Zysman |
| 3,638,254 | A | | 2/1972 | Falkenau |
| 3,653,083 | A | | 4/1972 | Lapidus |
| 3,658,082 | A | | 4/1972 | DiTirro |
| 3,815,887 | A | | 6/1974 | Curtis et al. |
| 3,826,409 | A | * | 7/1974 | Chilcoate ..... 222/107 |
| 3,879,776 | A | | 4/1975 | Solen |
| 4,120,061 | A | | 10/1978 | Clark |
| 4,169,295 | A | | 10/1979 | Darling |
| 4,173,385 | A | | 11/1979 | Fenn et al. |
| 4,241,740 | A | * | 12/1980 | Brown ..... 600/541 |
| 4,371,997 | A | | 2/1983 | Mattson |
| 4,477,935 | A | | 10/1984 | Griffin |
| 4,488,322 | A | | 12/1984 | Hunt et al. |
| 4,545,405 | A | | 10/1985 | LaBelle |
| 4,605,582 | A | | 8/1986 | Sias et al. |
| 4,644,597 | A | | 2/1987 | Walker |
| 4,662,012 | A | | 5/1987 | Torbet |
| 4,679,264 | A | | 7/1987 | Mollura |
| 4,684,201 | A | | 8/1987 | Hutter |
| 4,686,722 | A | | 8/1987 | Swart |
| 4,688,283 | A | | 8/1987 | Jacobson et al. |
| 4,697,290 | A | | 10/1987 | Alklind et al. |
| 4,698,864 | A | | 10/1987 | Graebe |
| 4,797,962 | A | | 1/1989 | Goode |
| 4,852,195 | A | * | 8/1989 | Schulman ..... 5/713 |
| 4,895,352 | A | | 1/1990 | Stumpf |
| 4,908,895 | A | | 3/1990 | Walker |
| 647,374 | A | | 4/1990 | Brendel |
| 4,962,921 | A | | 10/1990 | Simmons |
| 4,989,283 | A | | 2/1991 | Krouskop |
| 4,995,124 | A | | 2/1991 | Wridge, Jr. et al. |
| 5,020,176 | A | | 6/1991 | Dotson |
| 5,023,967 | A | | 6/1991 | Ferrand |
| 5,029,939 | A | * | 7/1991 | Smith et al. ..... 297/284.1 |
| 5,033,133 | A | | 7/1991 | Nissen |
| 5,051,673 | A | | 9/1991 | Goodwin |
| 5,052,068 | A | | 10/1991 | Graebe |
| 5,062,169 | A | | 11/1991 | Kennedy et al. |
| 5,070,560 | A | | 12/1991 | Wilkinson |
| 5,090,076 | A | | 2/1992 | Guldager |
| 5,090,077 | A | | 2/1992 | Caden et al. |
| 5,109,561 | A | | 5/1992 | Schild |
| 5,111,544 | A | | 5/1992 | Graebe |
| 5,142,717 | A | | 9/1992 | Everard et al. |
| 5,144,705 | A | | 9/1992 | Rogers |
| 5,249,318 | A | | 10/1993 | Loadsman |
| 5,267,364 | A | | 12/1993 | Volk |
| 5,345,629 | A | | 9/1994 | Ferrand |
| 5,375,273 | A | | 12/1994 | Bodine, Jr. et al. |
| 5,388,292 | A | | 2/1995 | Stinson et al. |
| 5,394,577 | A | | 3/1995 | James et al. |
| 5,453,081 | A | | 9/1995 | Hanson |
| 5,487,196 | A | | 1/1996 | Wilkinson |
| 5,502,855 | A | | 4/1996 | Graebe |
| 5,539,942 | A | | 7/1996 | Melou |
| 5,542,136 | A | | 8/1996 | Tappel |
| 5,560,057 | A | | 10/1996 | Madsen et al. |
| 5,564,142 | A | | 10/1996 | Liu |
| 5,584,085 | A | | 12/1996 | Banko |
| 5,586,346 | A | | 12/1996 | Stacy et al. |
| 5,594,963 | A | | 1/1997 | Berkowitz |
| 5,611,096 | A | | 3/1997 | Bartlett et al. |
| 5,630,237 | A | | 5/1997 | Ku |
| 5,634,224 | A | * | 6/1997 | Gates ..... 5/709 |
| 5,634,225 | A | | 6/1997 | Miller, Sr. et al. |
| 5,652,985 | A | | 8/1997 | Wilkinson et al. |
| 5,659,908 | A | | 8/1997 | Nishino |
| 5,699,570 | A | | 12/1997 | Wilkinson et al. |
| 5,701,622 | A | | 12/1997 | Biggie et al. |
| 5,787,531 | A | | 8/1998 | Pepe |
| 5,794,288 | A | | 8/1998 | Soltani et al. |
| 5,873,137 | A | | 2/1999 | Yavets-Chen |
| 5,893,184 | A | | 4/1999 | Murphy |
| 5,963,997 | A | | 10/1999 | Hagopian |
| 5,983,429 | A | | 11/1999 | Stacy et al. |
| 6,014,784 | A | | 1/2000 | Taylor et al. |
| 6,092,249 | A | | 7/2000 | Kamen et al. |
| 6,151,739 | A | | 11/2000 | Meyer et al. |
| 6,209,159 | B1 | | 4/2001 | Murphy |
| 6,223,369 | B1 | | 5/2001 | Maier et al. |
| 6,269,505 | B1 | | 8/2001 | Wilkinson |
| 6,317,912 | B1 | | 11/2001 | Graebe et al. |
| 6,349,439 | B1 | | 2/2002 | Cook et al. |
| 6,367,106 | B1 | * | 4/2002 | Gronsman ..... 5/709 |
| 6,370,716 | B1 | | 4/2002 | Wilkinson |
| 6,461,695 | B1 | * | 10/2002 | Schaap ..... 428/34.1 |
| 6,551,450 | B1 | | 4/2003 | Thomas et al. |
| 6,564,411 | B2 | | 5/2003 | Pirzada |
| 6,684,434 | B2 | | 2/2004 | Ellis et al. |
| 6,687,936 | B2 | | 2/2004 | Graebe et al. |
| 6,694,556 | B2 | | 2/2004 | Stolpmann |
| 6,711,771 | B2 | | 3/2004 | Cook et al. |
| 6,804,848 | B1 | | 10/2004 | Rose |
| 6,826,795 | B2 | | 12/2004 | Wilkinson |
| 6,877,178 | B2 | | 4/2005 | Chapman et al. |
| 6,922,862 | B1 | | 8/2005 | Thompson |
| D509,980 | S | | 9/2005 | Martin et al. |
| 6,976,281 | B2 | | 12/2005 | Schunk et al. |
| 7,086,104 | B1 | | 8/2006 | Tsay |
| 7,434,283 | B2 | | 10/2008 | Wilkinson et al. |
| 7,617,554 | B2 | | 11/2009 | Wilkinson |
| 7,886,386 | B2 | | 2/2011 | Balonick et al. |
| 8,122,545 | B2 | | 2/2012 | Wilkinson |
| 8,261,387 | B2 | | 9/2012 | Lipman et al. |
| RE44,584 | E | | 11/2013 | Wilkinson |
| 8,615,831 | B2 | | 12/2013 | Lipman et al. |
| 2001/0023511 | A1 | | 9/2001 | Wilkinson |
| 2002/0116766 | A1 | | 8/2002 | Stolpmann |
| 2003/0024051 | A2 | | 2/2003 | Wilkinson |
| 2003/0159219 | A1 | | 8/2003 | Harrison et al. |
| 2003/0208849 | A1 | | 11/2003 | Wilkinson |
| 2004/0068801 | A1 | | 4/2004 | Wilkinson |
| 2004/0222684 | A1 | | 11/2004 | VanSickle |
| 2005/0050637 | A1 | | 3/2005 | Graebe |
| 2005/0125905 | A1 | | 6/2005 | Wilkinson |
| 2005/0177952 | A1 | | 8/2005 | Wilkinson et al. |
| 2006/0085919 | A1 | | 4/2006 | Kramer et al. |
| 2006/0236464 | A1 | | 10/2006 | Beck et al. |
| 2007/0186349 | A1 | | 8/2007 | Lipman et al. |
| 2008/0028534 | A1 | | 2/2008 | Wilkinson |
| 2010/0180384 | A1 | | 7/2010 | Balonick et al. |
| 2013/0000048 | A1 | | 1/2013 | Lipman et al. |
| 2014/0109319 | A1 | | 4/2014 | Wilkinson |
| 2014/0208519 | A1 | | 7/2014 | Balonick |

FOREIGN PATENT DOCUMENTS

| | | | |
|---|---|---|---|
| EP | 0302579 | A1 | 2/1989 |
| EP | 0812555 | A2 | 12/1997 |
| JP | 03-267013 | | 3/1990 |
| JP | 08-038559 | | 2/1996 |
| JP | 2003052492 | | 2/2003 |
| WO | 9409686 | A1 | 5/1994 |
| WO | WO 94/10881 | | 5/1994 |
| WO | 9603252 | | 2/1996 |
| WO | 9745038 | A1 | 12/1997 |
| WO | 03073825 | A2 | 9/2003 |
| WO | 2004028307 | | 4/2004 |

OTHER PUBLICATIONS

Application No. EP06719321 / Patent No. 1845823, Supplemental European Search Report dated Oct. 13, 2010. 7 pages.

(56) References Cited

OTHER PUBLICATIONS

Application No. PCT/US00/10575, Supplemental International Search Report and the Written Opinion of the International Searching Authority, or the Declaration dated Feb. 19, 2002. 6 pages.
Application No. PCT/US00/10575, International Search Report dated Aug. 14, 2000. 1 page.
Application No. EP 00 92 8223, European Search Report dated Oct. 8, 2004. 4 pages.
Application No. PCT/US06/02411, International Search Report and the Written Opinion of the International Searching Authority, or the Declaration dated May 3, 2006. 9 pages.
Application No. PCT/US05/04293, International Search Report and the Written Opinion of the International Searching Authority, or the Declaration dated Apr. 25, 2007. 8 pages.
Application No. EP 05 71 3316, European Search Report dated Jun. 2, 2010. 6 pages.
Office Action (dated Dec. 5, 2003) for U.S. Appl. No. 10/404,952, filed Mar. 31, 2003.
Office Action (dated Jul. 28, 2004) for U.S. Appl. No. 10/404,952, filed Mar. 31, 2003.
Office Action (dated Jan. 12, 2005) for U.S. Appl. No. 10/404,952, filed Mar. 31, 2003.
Office Action (dated Sep. 12, 2005) for U.S. Appl. No. 10/404,952, filed Mar. 31, 2003.
Office Action (dated Apr. 28, 2006) for U.S. Appl. No. 10/404,952, filed Mar. 31, 2003.
Office Action (dated Dec. 22, 2006) for U.S. Appl. No. 10/404,952, filed Mar. 31, 2003.
Office Action (dated Jun. 8, 2007) for U.S. Appl. No. 10/404,952, filed Mar. 31, 2003.
Office Action (dated Jan. 21, 2001) for U.S. Appl. No. 11/841,047, filed Aug. 20, 2007.
Office Action (dated Apr. 15, 2003) for U.S. Appl. No. 10/202,138, filed Jul. 23, 2002.
Office Action (dated Mar. 25, 2004) for U.S. Appl. No. 10/202,138, filed Jul. 23, 2002.
Office Action (dated Dec. 3, 2004) for U.S. Appl. No. 10/202,138, filed Jul. 23, 2002.
Office Action (dated Mar. 27, 2006) for U.S. Appl. No. 10/202,138, filed Jul. 23, 2002.
Office Action (dated Oct. 18, 2006) for U.S. Appl. No. 10/202,138, filed Jul. 23, 2002.
Office Action (dated Jan. 31, 2007) for U.S. Appl. No. 10/202,138, filed Jul. 23, 2002.
Office Action (dated Jul. 5, 2007) for U.S. Appl. No. 10/202,138, filed Jul. 23, 2002.
Office Action (dated Mar. 4, 2011) for U.S. Appl. No. 10/202,138, filed Jul. 23, 2002.
Decision on Appeal (dated Aug. 9, 2011) for U.S. Appl. No. 10/404,962, filed Mar. 31, 2003.
Application No. EP 06 71 9321, Supplemental European Search Report dated Oct. 20, 2010. 7 pages.
Office Action (dated Jun. 15, 2011) for U.S. Appl. No. 10/202,138, filed Aug. 20, 2007.
Office Action (dated Jan. 5, 2015) for U.S. Appl. No. 11/841,047, filed Aug. 20, 2007.
Office Action (dated Feb. 12, 2015) for U.S. Appl. No. 14/075,764, filed Nov. 8, 2013.
Atlantis Medical, Inc.; "ZAAM Zoned Adjustable Air Mattress"; ZAAM product brochure; published 1996; no volume, page or issue number; publisher Atlantis Medical, Inc.; published in New Brunswick, New Jersey.
Atlantis Medical, Inc., "SAM self-adjusting mattress"; SAM product brochure; published 1997; no volume, page or issue number; publisher Atlantis Medical, Inc.; published in New Brunswick, New Jersey.
Lotech Support Systems Limited; "LoTech Air 2000"; LoTech Air 2000 product brochure; published 1995; no volume, page or issue number; publisher LoTech Support Systems Limited; published in Bennington, Vermont.
Atlantis Medical, Inc.; "SAM self-adjusting mattress"; SAM product brochure; published 1996; no volume, page or issue number; publisher Atlantis Medical, Inc.; published in New Brunswick, New Jersey.
Atlantis Medical, Inc.; "SAM self-adjusting mattress"; SAM product brochure; published 1996; no volume, page or issue number; publisher Atlantis Medical, Inc.; published in Washington, DC area by filing in the USPTO on Mar. 11, 1996.
BG Industries, INC.; "AccuMax PC Self Adjusting Pressure Management System"; published 1998; no volume, page or issue number; publisher BG Industries, Inc.; published in Northridge, California.
Comfort Direct, Inc.; 'Comfort Direct for All Your Comfort Needs'; Comfort Direct product Catalogue, pp. 1,2,3; ; published in 2000; publisher Comfort Direct, Inc.; published in New Brunswick, New Jersey.
Direct Supply, Inc.; "Capital Equipment"; Direct Supply product catalogue; vol. 728OR,p. 6, front cover, back cover; publisher Direct Supply, Inc.; published 2004; published in Milwaukee, Wisconsin.
KCI, Inc.; "Atmos Air Atmospheric Therapy"; KCI seating cushion product brochure and owner's guide; no volume, page or issue number; published 2000; publisher KCI, Inc.; published in San Antonio, Texas.
KCI, Inc.; ΘAtmos Air With SAT; KCI Atmos Air product brochures for 4000MRS, 9000MRS, 9000A MRS, 9000AR MRS and APOD 25; no volume, page or issue number, published 2004; publisher KCI, Inc.; published in San Antonio, Texas.

* cited by examiner

INFLATABLE CUSHIONING DEVICE WITH MANIFOLD SYSTEM

CROSS REFERENCE TO RELATED APPLICATIONS

The present patent application is a continuation-in-part of a copending non-provisional U.S. patent application Ser. No. 10/404,962, filed Mar. 31, 2003 by the present inventor and entitled "Inflatable Cushioning Device With Manifold System," which is a continuation application of U.S. patent application Ser. No. 09/867,308, filed Mar. 29, 2001 by the present inventor which is a divisional of U.S. patent application Ser. No. 09/295,139, filed on Apr. 20, 1999 by the present inventor. In addition, the present application claims the benefit of Provisional Patent Application Ser. No. 60/544,366, filed Feb. 13, 2004 by the present inventor.

FIELD OF THE INVENTION

The present invention relates generally to a fluid cell for use in a mattress or support surface which allows for discrete support of a body and a support surface which allows for discrete support of a body. The present invention includes reforming elements that are resilient fluid cells having a spring bias.

BACKGROUND OF THE INVENTION

Heretofore, inflatable cushioning devices for use with body supports, such as a mattress, sofa, seat, or the like, typically included a plurality of air cells or bladders that are inflated to support a person. The air cells provide support to the person, and can be inflated to a desired pressure level to provide the person with a predetermined level of comfort and support.

In the medical field, cushioning devices including a plurality of air cells are often used to provide different levels of support under various portions of a patient's body. For example, a mattress may include separate air cells located in the upper, middle, and lower portions of the mattress. These air cells can be inflated to different pressures to support the upper, middle, and lower portions of the patient's body with different pressures.

In hospitals which provide care to patients confined to a bed for extended periods of time, the patients often suffer from the effects of excess pressure transmitted to their bodies. As known in the medical field, continuous pressure applied to a patient's body can cause soft tissue damage. When the external pressure exerted on the patient's skin causes blood carrying capillaries to close, soft tissue degeneration may occur. This soft tissue damage may lead to the formation of pressure sores. For example, continuous pressure applied to a patient's heel can cause a pressure sore to develop on the heel. The multi-cell cushioning devices described above can be used to relieve the pressure applied to a specific portion of a patient's body. In the case of a patient's heel, for example, this may be accomplished by inflating the air cell under the patient's leg so that the heel is lifted from the mattress. Thus, the continuous heel pressure is relieved and the formation of a bed sore on the heel is prevented.

Air cushion devices typically require an external pump to inflate the air cells in the device. Alternatively, the air cushion devices are pre-inflated in the manufacturing plant and are shipped to a field location for use. A problem may develop when the atmospheric pressure at the inflation location is different from the atmospheric pressure at the field location where the device is used. For example, if the field location atmospheric pressure is lower than the atmospheric pressure at the inflation location, the air cells in the field will expand and become firmer.

Hospitals rate pressure relief support systems as "treatment products" if they sufficiently reduce the pressure upon a patient's body, reduce tissue trauma, and facilitate the healing of skin ailments, such as burns, pressure sores, etc. Typical pressure relief support systems which qualify as "treatment products" are embodied in beds which contain motors and pumps to vary the shape and pressure within the mattress. Such beds are very expensive and require the operator to undergo extensive training to learn how to use and operate the system. Furthermore, the "treatment products" often require extensive maintenance due to the failure of the numerous moving mechanical parts. Also, these complicated pressure relief support systems cannot be used on typical box spring mattress supports, and require specialized bed frames. The complicated design of these beds makes their repair very difficult, and often requires the complete replacement of the entire system for proper servicing. A further difficulty is that during power outages, these mattresses lose pressure leaving a patient on a hard surface to develop pressure sores if action is not taken. Thus, a need exists to arrive at a body support which adequately addresses these disadvantages.

SUMMARY OF THE INVENTION

The present invention provides a cushioning device for a mattress, seat, sofa, or the like where support is obtained from a fluid such as atmospheric air. The cushioning device has few moving parts, is user controllable, requires minimal maintenance, and is easily repairable. The cushioning device of the present invention includes a support system apparatus, a sleeve apparatus, a jacket, a topper cushion, and an outer cover.

The support system apparatus includes at least one support cell for providing lifting support for a body. Each support cell includes an envelope containing a fluid. Application of an external load on an outer surface of the envelope causes the envelope to deform into a compressed form. The envelope includes a reforming element that is capable of providing a reforming force to the interior surface of the envelope, to return the envelope to its original unloaded form. The reforming element is preferably made from a resilient foam material, however, other resilient means can be used.

An inlet port, outlet port, intake valve, and an exhaust valve are included in each support cell. The inlet and outlet ports are located directly on the fluid cell and are positioned adjacent or proximate one another. The exhaust valve in each support cell is connected to an exhaust control system via a lateral conduit which extends directly from the fluid cell. The intake valve in each support cell is connected to an intake control system. Each intake valve includes an intake check valve allowing fluid to flow into the support cell, while preventing fluid from flowing out of the support cell. Each exhaust valve includes an exhaust check valve allowing fluid to flow out of the support cell, while preventing fluid from flowing into the support cell. The intake control system is connected to a fluid supply reservoir. The exhaust control system is connected to a fluid exhaust reservoir. Preferably, the fluid included in the supply and exhaust reservoirs is air, however, any suitable fluid, e.g., water or nitrogen, can be used. The fluid supply and exhaust reservoirs may comprise the same reservoir, and may comprise an ambient source of fluid such as atmospheric air.

In use, the weight of a body of a person, patient, or animal resting on the envelope deforms the envelope. For illustration purposes, a patient will be used as an example of a body resting on a the envelope. The pressure of the fluid within the envelope increases as the volume of the envelope decreases under deformation. As the pressure of the fluid increases, the fluid in the envelope flows out of the envelope through the exhaust valve and into the exhaust control system. Next, the fluid flows from the exhaust control system into the fluid exhaust reservoir. Furthermore, as the envelope deforms to conform to the irregular shape of the patient, the area of the envelope supporting the load increases. Equilibrium is achieved when the forces within the envelope, including the pressure of the fluid within the envelope multiplied by the area of the envelope supporting the load, plus the force provided by the reforming element equal the weight of the load.

A controllable pressure relief valve is included in the exhaust control system so that a maximum pressure level of the fluid within the envelope can be set and maintained. Different selected maximum pressure levels of the fluid allow the support cell to accommodate different weights or allow different degrees of conformation between the patient and the envelope surface. Preferably, the maximum pressure level of the fluid is set to ensure that the interface pressure under the entire contact surface of the patient is below the pressure that may cause soft tissue damage such as pressure sores to occur.

As the weight of the patient is removed from the support cell, the reforming element exerts an outward force on the interior surface of the envelope. As the envelope expands, a partial vacuum is created in the interior space of the envelope, causing fluid to be drawn back into the interior space of the envelope. The fluid is drawn from the fluid supply reservoir into the intake control system, through the intake valve, and into the interior space of the envelope. The intake valve includes a one way intake check valve that permits fluid to re-enter the interior space of the envelope, while preventing fluid from exiting the interior space of the envelope.

The support cells included in the present invention can use atmospheric pressure as the pressure source for inflation. Therefore, when the fluid supply and exhaust reservoirs comprise atmospheric air, non-powered inflation can be accomplished without the need for expensive blowers, pumps or microprocessors as required by previously available "treatment products." A plurality of support cells can be interconnected via a lateral conduit to the intake control system and via a lateral conduit to the exhaust control system to create a support system apparatus. Interconnecting the support cells allows a constant pressure to be maintained across the fluid cells. The support system apparatus can support a patient by providing self adjusting pressure management to the entire contact surface of the patient. The support system apparatus provides a low interface pressure under the entire surface of the patient being supported. For example, if the patient is lying on the support system apparatus, the support system apparatus ensures that the interface pressure under the entire contact surface of the patient is below the pressure that may cause soft tissue damage to occur.

The support system apparatus also has the ability to self-adjust every time a patient moves, or is repositioned on the support system apparatus. When the pressure distribution applied to the support system apparatus changes, the support cells within the support system apparatus automatically inflate or deflate as necessary, to maintain a low interface pressure under the entire patient.

Another embodiment of the current invention provides for separately controlled support zones within the support system apparatus. Each support zone comprises at least one support cell. Each support cell includes at least one intake valve and at least one exhaust valve. The intake valve for each support cell in each support zone is connected to a manifold system, including a conduit having a plurality of lateral conduits extending therefrom, included in the intake control system. The exhaust valves from each support cell in a single support zone are connected to a manifold system, including a conduit having a plurality of lateral conduits extending therefrom, included in a single exhaust control system. Each support zone has a separate exhaust control system. The intake control system is connected to the fluid supply reservoir. The exhaust control system for each support zone is connected to the fluid exhaust reservoir. Generally the pressure level in each support zone is set at a different level. For example, if the support system apparatus comprises a mattress in a bed, the upper, middle, and lower zones of the support system apparatus can be set to provide a different level of pressure or firmness for the upper, middle, and lower portions of the patient's body.

The sleeve apparatus includes a cell cover surrounding each support cell. For a plurality of support cells, each cell cover is attached to an adjacent cell cover. The cell cover allows the surface of the envelope of the support cell to slide freely along a first side of the cell cover, without transmitting this sliding movement to a second side of the cell cover. The second side of the cell cover can be the side on which a patient is lying. Therefore, movement of the support cell is not transmitted to the patient, thereby preventing frictional or shear force abrasion damage to the skin of the patient. In the event that repair of a support cell becomes necessary, the sleeve apparatus allows each support cell to be easily removed and replaced.

Another embodiment of the present invention provides an additional alternating pressure system for providing alternating supply pressure to a plurality of zones. The alternating pressure system can be used in combination with the support system apparatus. Each zone includes at least one support cell. The alternating pressure system includes a pressurized fluid supply source including a pump, a pressurized fluid tank, etc. Additionally, the alternating pressure system includes a control system for sequentially supplying fluid pressure to the plurality of zones. The raising and lowering of the alternating zones under a patient provides beneficial movement of the skeleton and tissue in the patient. The movement helps stimulate circulation and lymph fluid movement in the patient. When the alternating pressure system is deactivated or fails, the support system apparatus continues to provide self adjusting pressure management to the patient's body.

The jacket houses the support system apparatus, the intake and exhaust control systems, and portions of the alternating pressure system. The jacket can be made from any suitable stretchable material, and is preferably is formed from a stretchable fabric material.

The topper cover provides further resilient torso support. The topper cover may be formed from a layered fiber filled material or other suitable material. The topper may include a resilient heel support unit to reduce pressures on the sensitive heel region of a patient. The topper cover may rest above the jacket, and may be covered by the outer cover. Alternatively, the topper cover may rest above the support system apparatus.

The outer cover provides a low friction and low shear surface further protecting the patient from frictional tissue damage. Additionally, the outer cover provides a waterproof and stain resistant surface. For medical uses the outer cover can be made from an anti-microbial type material.

Another embodiment of the present invention provides a support surface or mattress containing a plurality of support cells that are discrete fluid cells having reforming capability. The discrete fluid cells each have a spring bias. Application of an external load on an outer surface of a fluid cell causes the fluid cell to deform into a compressed form when the load has a force which is greater than the sum of the forces within the fluid cell, including the pressure of the fluid inside the fluid cell multiplied by the area of the fluid cell supporting the load, plus the reforming force of the fluid cell. Once the load is reduced, the reforming force of the fluid cell causes the fluid cells to reform to original unloaded form. Equilibrium is achieved when the forces within the envelope, including the pressure of the fluid within the envelope multiplied by the area of the envelope supporting the load, plus the force provided by the reforming element equal the weight of the load. The fluid cells exert variable force and expand and compress depending on the load encountered.

The support system apparatus containing the spring biased fluid cells also includes a base housing, or casing, which receives the fluid cells and affixes the cells together to form a mattress construct. The fluid cells within the casing are connected to the intake control system and the exhaust control system, including a controllable pressure relief valve, to create a support system apparatus. Both fluid cell movement and the firmness and softness of the fluid cells are determined by the properties of the fluid cell and the pressure level at which the controllable pressure relief valve is set. For example, variables such as base material height, ILD (Incidence of Load Deflection), density of the fluid cell material, air pressure, fluid cell height, air flow control, air sound control, direction of air flow, and speed of air movement all affect the response of the fluid cell to a force. Air sound control is achieved using sound control battening which reduces the sound during intake and exhaust of the air cell.

The cushioning device of the present invention allows a user in the field to adjustably set the maximum pressure level in each support cell. When surrounded by atmospheric air, the support system apparatus is self-inflating, self-adjusting, and does not require expensive pumps and control systems as required by related "treatment product" art. Also, since there are fewer moving parts in the present invention, maintenance and repairs are simple and reasonable in cost compared to the complex related art.

The cushioning device of the present invention can be used in combination with any support device where self adjusting dynamic pressure support of the person or patient is required. For example, these support devices can be mattresses, sofas, seats, etc.

A first general aspect of the present invention provides a fluid cell for use in a support surface comprising:

a spring bias in said fluid cell of said support surface to reform said fluid cell such that each said fluid cell collapses when loaded with a load having a force which is greater than the sum of the forces within the fluid cell, including the pressure of the fluid inside the fluid cell multiplied by the area of the fluid cell supporting the load, plus the reforming force of the fluid cell, and said fluid cell reforms when said load is reduced to a load having a force which is less than the sum of the forces within the fluid cell and the reforming force of the fluid cell, wherein said fluid cell is self inflating.

A second general aspect of the present invention provides a support surface comprising:

a plurality of self-inflating fluid cells, wherein each said self-inflating fluid cell has a spring bias to reform said self-inflating fluid cell and at least one port; and a casing adapted to receive said plurality of self-inflating fluid cells, wherein said casing affixes said self-inflating fluid cells together to form a mattress construct.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION OF THE INVENTION

Figure 1:
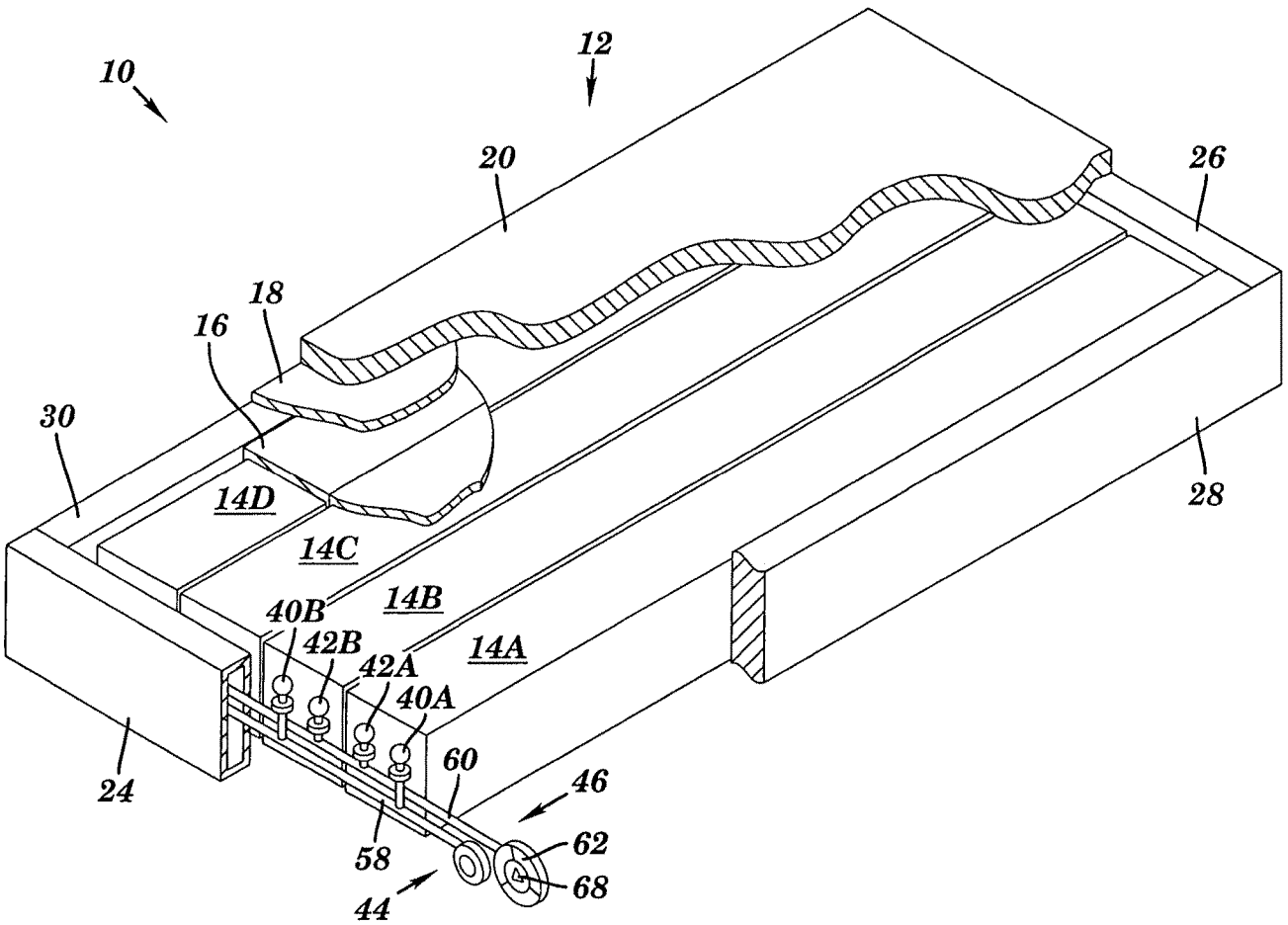
FIG. 1 illustrates a perspective view of an inflatable cushioning device of the present invention.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment. The features and advantages of the present invention are illustrated in detail in the accompanying drawings, wherein like reference numerals refer to like elements throughout the drawings. Although the drawings are intended to illustrate the present invention, the drawings are not necessarily drawn to scale.

Referring to FIG. 1, there is illustrated a perspective view of a cushioning device 10 in accordance with a preferred embodiment of the present invention. The cushioning device 10 can be used in combination with any support device where self-adjusting dynamic pressure support of a person or patient 56 (FIG. 14) is required. For example, the support device may include a mattress, sofa, seat, etc. The cushioning device 10 includes a support system apparatus 12 comprising at least one support cell 14, a sleeve apparatus 16 (FIG. 5), a jacket 18 (FIG. 5), and a topper cushion 20.

The support system apparatus 12 includes at least one support cell 14 for providing lifting support for a patient 56. An intake valve 40 and an exhaust valve 42 are included in each support cell 14. As illustrated in FIG. 1, the cushion device 10 also includes two end walls 24, 26, and two side walls 28, 30. The end walls 24, 26, and the side walls 28, 30 can be formed from a resilient material such as foam or rubber. The topper cushion 20 rests on top of the jacket 18 and provides further cushioning to a body. The topper cushion 20 can be composed of any resilient material, for example, foam, down feathers, an inflatable air cushion, etc.

Figure 2:
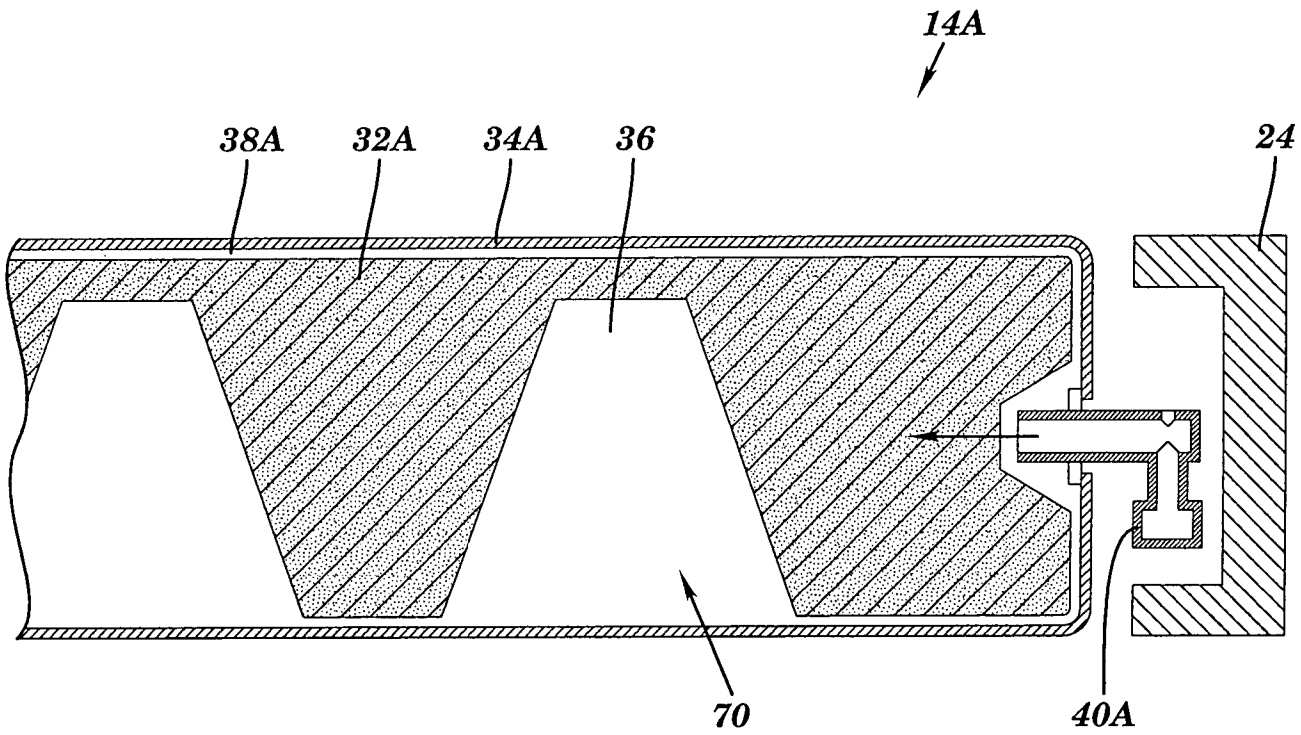
FIG. 2 illustrates a partial cross-sectional view of a support cell including a reforming element and an intake valve.
Figure 17:
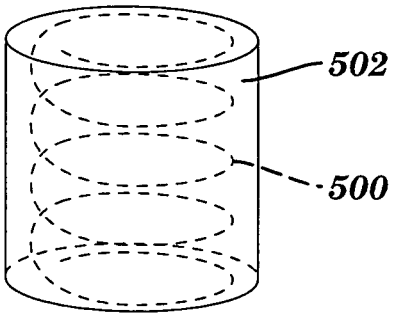
FIG. 17 illustrates a perspective view of a coiled spring resilient support.
Figure 18:
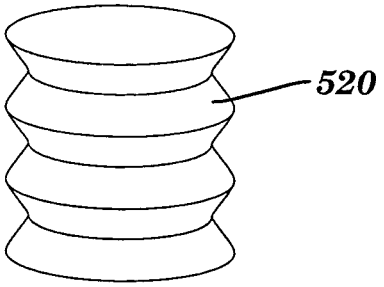
FIG. 18 illustrates a perspective view of a bellows resilient support.

FIG. 2 illustrates a partial cross-sectional view of the support cell 14A including an envelope 34A and a reforming element 32A. The envelope 34A contains a fluid 36. The application of an external load on the envelope 34A causes the envelope 34A to deform into a compressed form. The reforming element 32A provides a reforming force to the interior surface 38A of the envelope 34A. The reforming force causes the envelope 34A to return to its original form when the external load is removed from the envelope 34A. The reforming element 32A is preferably a resilient foam material, however, other resilient means can be used such as a coiled spring 500 (FIG. 17) or a bellows 520 (FIG. 18). The coiled spring 500 is surrounded by a resilient material 502. The bellows 520 may be formed from a pliable resilient material such as plastic and filled with a fluid such as air. Similar to the fluid cell 614 shown in FIG. 23, the reforming element may have a double, or twin, helical pattern 530 on its outer construct.

Figure 3:
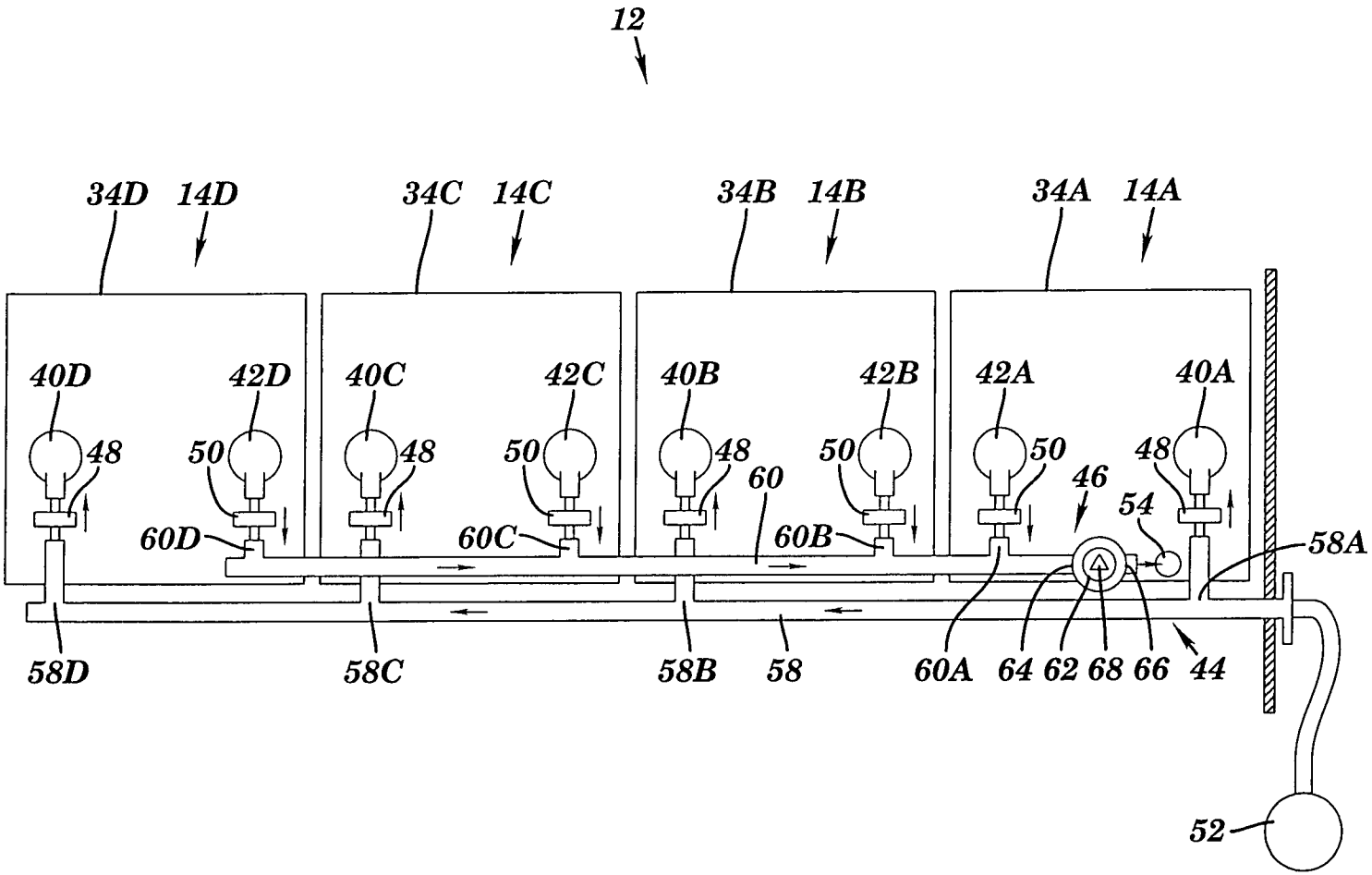
FIG. 3 illustrates an end view of a support system apparatus.

An example of a support system apparatus 12 for a mattress includes a plurality of support cells 14A, 14B, 14C, and 14D is illustrated in FIGS. 1 and 3. An example of interior cells, 14A, and 14D, and end cells, 14B and 14C, are depicted in FIGS. 1 and 3. Intake valves 40A, 40B, 40C, 40D, and exhaust valves 42A, 42B, 42C and 42D are also illustrated in FIG. 3. Each intake valve 40 includes an intake check valve 48 allowing fluid 36 to flow into the support cell 14, while preventing fluid 36 from flowing out of the support cell 14. Each exhaust valve 42 includes an exhaust check valve 50 allowing fluid 36 to flow out of the support cell 14, while preventing fluid 36 from flowing back into the support cell 14. Each exhaust valve 42 is connected to an exhaust conduit via T-intersection 60A, 60B, 60C, and 60D in a manifold 60 included in an exhaust control system 46. Each intake valve 40 is preferably connected to an intake conduit via T-intersection 58A, 58B, 58C, and 58D in a manifold 58 included in an intake control system 44.

The intake control system 44 is connected to a fluid supply reservoir 52. The exhaust control system 46 is connected to a fluid exhaust reservoir 54. Generally, the fluid 36 included in the fluid supply reservoir 52 and the fluid exhaust reservoir 54 is air, however, any suitable fluid 36 (e.g. water or nitrogen) can be used. The fluid supply reservoir 52 and the fluid exhaust reservoir 54 may comprise the same reservoir, and may comprise an ambient source of fluid 36 such as atmospheric air.

Figure 14:
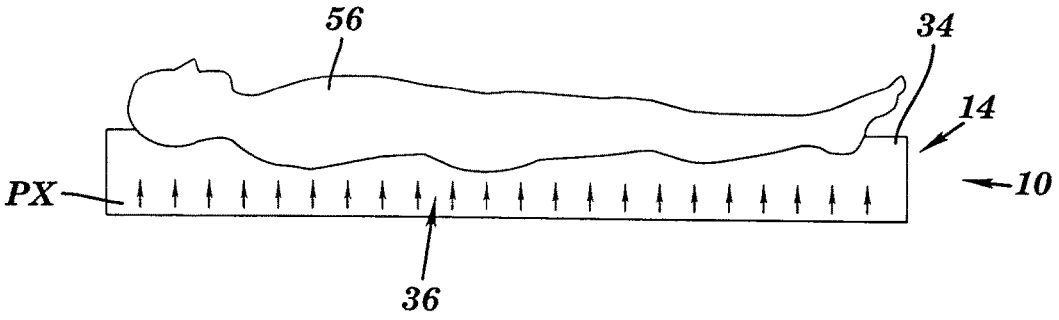
FIG. 14 illustrates a cross-sectional view of the patient being supported by the cushioning device of the present invention, wherein a low interface pressure is provided under the patient.

As illustrated in FIG. 14, the weight of a body such as a patient 56 resting on the cushion device 10 deforms the envelope 34 in each support cell 14. The pressure of the fluid 36 within each envelope 34 increases as the volume of the envelope 34 decreases under deformation. As the pressure of the fluid 36 increases, the fluid 36 in each envelope 34 flows out of the envelope 34 through a corresponding exhaust valve 42 and into the exhaust control system 46 (FIGS. 1 and 3) such that the pressure of each fluid cell is independent of the pressure of each other fluid cell. Next, the fluid 36 flows from the exhaust control system 46 into the fluid exhaust reservoir 54. Furthermore, as each envelope 34 deforms to conform to the irregular shape of the patient 56, the area of the envelope 34 supporting the load increases. Equilibrium is achieved when the forces within the envelope 34, including the pressure of the fluid 54 within the envelope 34 multiplied by the area of the envelope 34 supporting the load, plus the force provided by the reforming element 32, equal the weight of the load.

As illustrated in FIG. 3 a controllable pressure relief valve 62 is included in the exhaust control system 46 and is attached to an end 64 of the exhaust conduit 60. The outlet 66 of the controllable pressure relief valve 62 is attached to the fluid exhaust reservoir 54. The controllable pressure relief valve 62 controls the maximum pressure level of the fluid 36 in the exhaust conduit 60 and in each envelope 34 in each support cell 14. A rotatable knob 68 or other adjusting mechanism on the controllable pressure relief valve 62 allows a user to adjust the regulated maximum pressure level. Different selected maximum allowable pressures in the support cells 14A, 14B, 14C, and 14D allow the support system apparatus 12 to accommodate patients 56 of different weights. Also, the setting of different maximum allowable pressures in the support cells 14A, 14B, 14C, and 14D allows different degrees of conformation between the patient 56 and the surface of each envelope 34. The maximum pressure is preferably set to ensure that the interface pressure under the entire contact surface of the patient 56 is below the pressure that may cause tissue damage. The cushioning device 10 of the present invention allows a user in the field to adjustably set the maximum pressure level in each support cell 14. The maximum pressure is preferably above about 6 inches of water but is optimally in the range of about 8 to 12 inches of water. Other ranges may also be used, depending on operational requirements, user preferences, etc.

Figure 13:
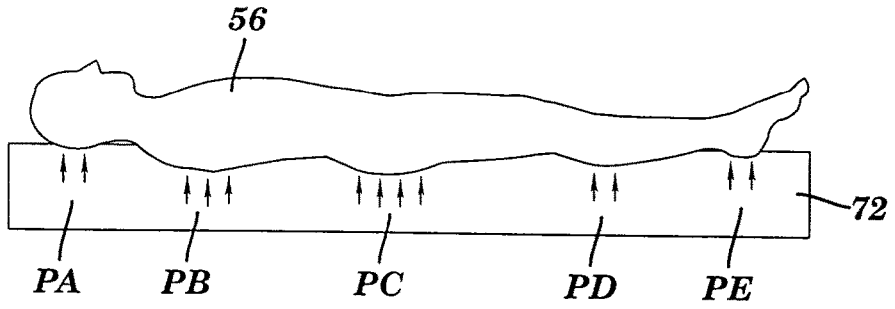
FIG. 13 illustrates a cross-sectional view of a patient lying on a conventional mattress.

FIG. 13 illustrates the patient 56 resting on a conventional mattress 72. High pressure regions on the patient 56 are indicated by the force arrows PA, PB, PC, PD, and PE. FIG. 14 illustrates the patient 56 resting on a cushion device 10 of the present invention. As shown, the cushion device 10 provides a low uniform interface pressure PX that supports the entire contact surface of the patient 56. This interface pressure is below the pressure that may cause tissue damage, thereby preventing the formation of pressure sores and other injuries.

As the weight of the patient 56 is removed from each support cell 14, the reforming element 32 (FIG. 2) in each envelope 34 exerts a reforming force on the interior surface 38 of each envelope 34. As each envelope 34 expands, a partial vacuum is created in the interior space 70 of each envelope 34. The vacuum draws the fluid 36 from the fluid supply reservoir 52 into the intake control system 44. Next, the fluid 36 is drawn from the intake control system 44 through a corresponding intake valve 40 into the interior space 70 of each envelope 34. When the fluid supply reservoir 52 and the fluid exhaust reservoir 54 comprise atmospheric air, inflation can be accomplished without the need for expensive blowers, pumps or microprocessors as required by previously available "treatment products." The support system apparatus 12 of the present invention also has the ability to self-adjust every time a patient 56 moves, or is repositioned on, the support system apparatus 12. When the pressure distribution applied to the support system apparatus 12 changes, the support cells 14 within the support system apparatus 12 automatically inflate or deflate to restore the low interface pressure PX under the entire patient (FIG. 14).

Figure 4:
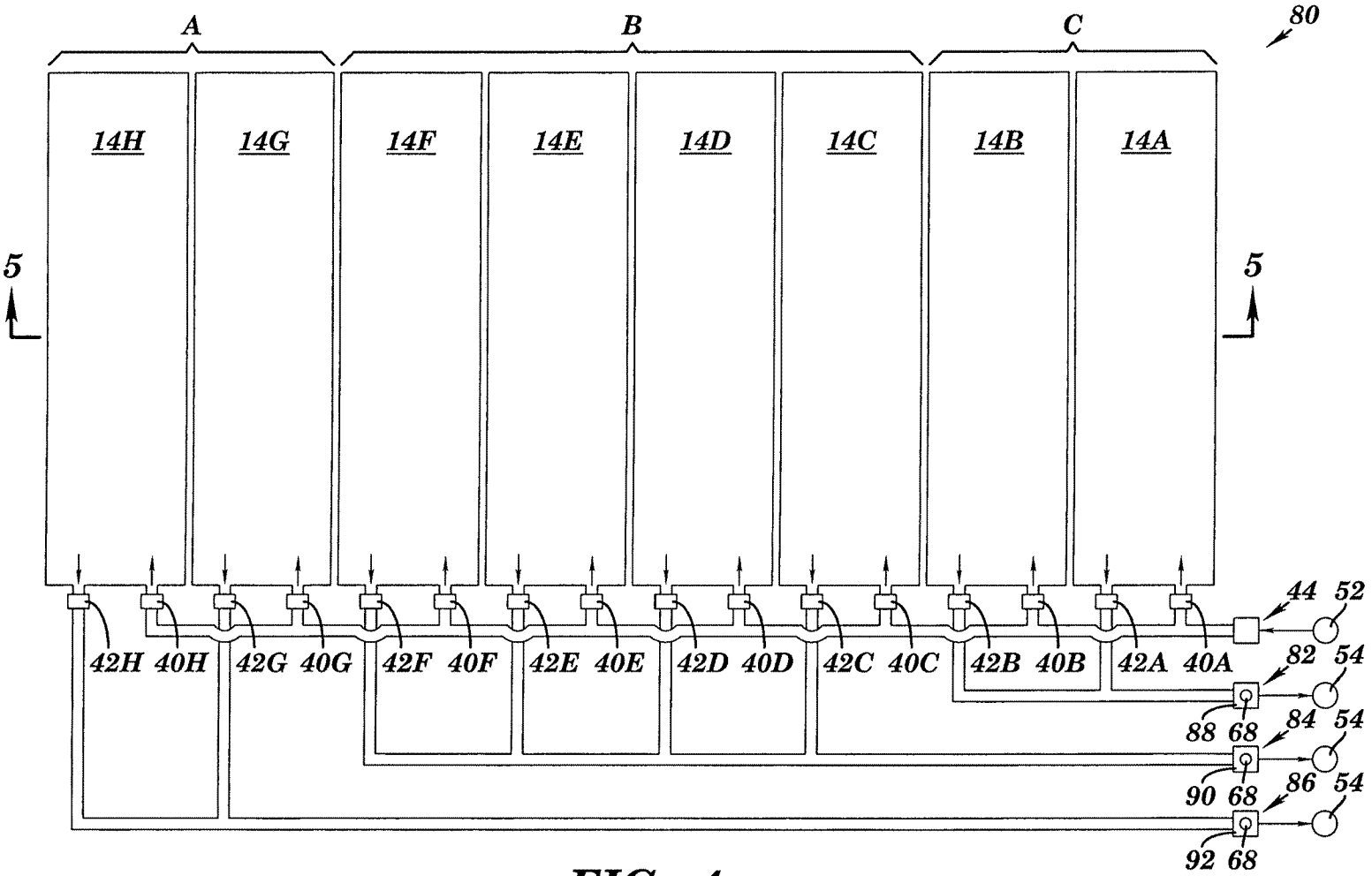
FIG. 4 illustrates a plan view of another embodiment of the support system apparatus including a plurality of controlled support zones.

Another embodiment of the present invention is illustrated in FIG. 4 and provides for separately controlled support zones "A," "B," and "C" within a support system apparatus 80. Each support zone "A," "B," and "C" includes at least one support cell 14. Each support cell 14 includes at least one intake valve 40 and at least one exhaust valve 42. As illustrated in FIG. 4, each intake valve 40A-40H is connected to the intake control system 44. The exhaust valves 42A and 42B in zone "C" are connected to an exhaust control system 82. The exhaust valves 42C, 42D, 42E and 42F in zone "B" are connected to an exhaust control system 84. The exhaust valves 42G and 42H in zone "A" are connected to an exhaust control system 86. Each intake valve 40A-40H allows fluid 36 to flow into each support cell 14A-14H, respectively, while preventing fluid 36 from flowing back out of each support cell 14A-14H, respectively. Each exhaust valve 42A-42H allows fluid 36 to flow out of each support cell 14A-14H, respectively, while preventing fluid 36 from flowing back into each support cell 14A-14H, respectively. The intake control system 44 is connected to the fluid supply reservoir 52. The exhaust control systems 82, 84, and 86 are connected to the fluid exhaust reservoir 54. Generally, the fluid 36 included in the fluid supply reservoir 52 and the fluid exhaust reservoir 54 is atmospheric air, however, other fluids 36 can be used.

Each exhaust control system 82, 84, and 86 includes a pressure relief valve 88, 90, and 92, respectively, that maintains the pressure of the fluid 36 in zones "A," "B," and "C" below a selected level. A rotatable knob 68 or other adjusting system included in each pressure relief valve 88, 90, and 92 allows a user to set the maximum pressure level of the fluid 36 in each zone "A," "B." and "C."

Figure 5:
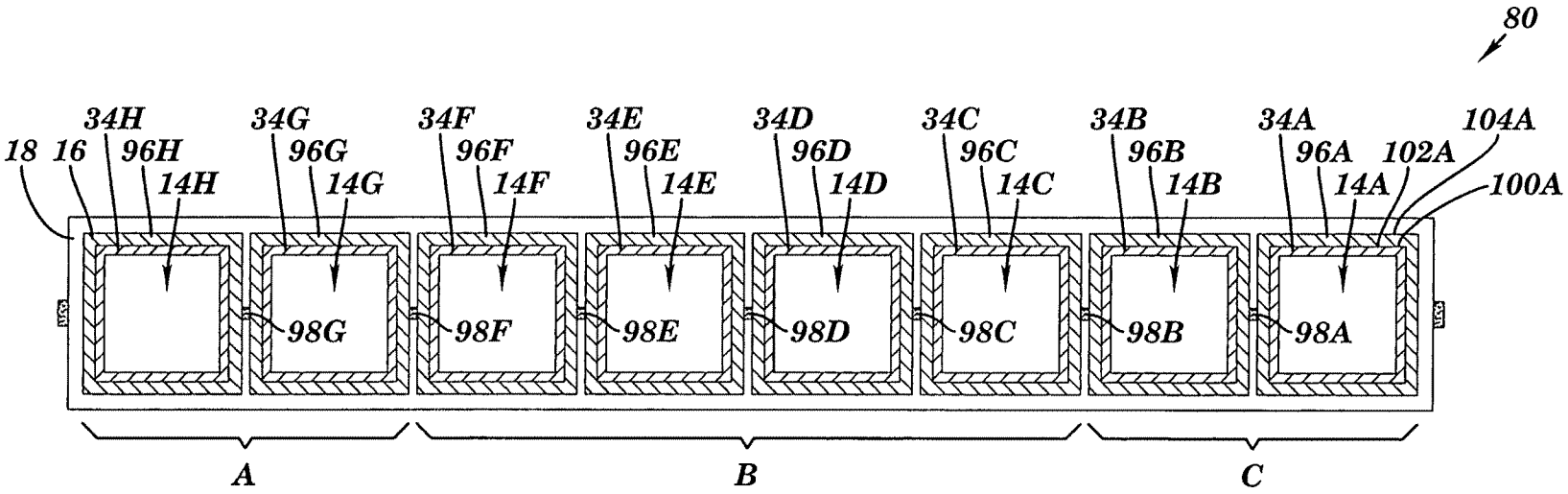
FIG. 5 illustrates a cross-sectional view of the support system apparatus taken along the line 5-5 of FIG. 4.
Figure 6:
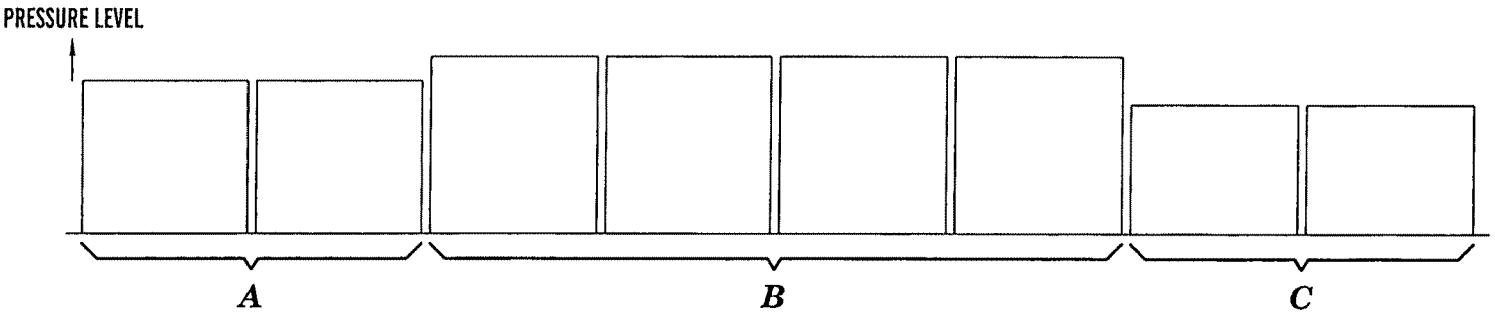
FIG. 6 illustrates an example of a pressure distribution in a plurality of zones in the support system apparatus of FIG. 5.

FIG. 5 illustrates a cross-sectional view of the support system apparatus 80 and zones "A," "B," and "C" taken along line 5-5 of FIG. 4. When atmospheric air is supplied to the fluid supply reservoir 52, there is no need for blowers or pumps to supply the pressurized fluid 36. Each support cell 14A-14H self-inflates when the weight of the patient 56 is removed as described above for the support system apparatus 12. Each exhaust control system 82, 84 and 86 allows the maximum pressure level of the fluid 36 in each zone "A," "B," and "C" to be individually set. FIG. 6 illustrates an example of different pressure levels set in zones "A," "B," and "C." For example, if the support system apparatus 80 is included in a mattress in a bed (not shown), a different level of pressure or firmness can be provided for the upper, middle, and lower portions of the patient's body 56.

As shown in FIG. 5, the sleeve apparatus 16 includes a cell cover 96 surrounding each support cell 14. Each support cell 14. Each cell cover 96A, 96B, 96C, 96D, 96E, 96F, 96G, and 96H, is attached to each adjacent cell cover 96 by connections 98A, 98B, 98C, 98D, 98E, 98F, and 98G. For example, the connections 98A-98G can be formed by a glued, heat sealed or sewn connection. Each cell cover 96 allows the exterior surface 100 of a corresponding envelope 34 to slide freely along an interior surface 102 of the cell cover 96, without transmitting this movement to an exterior surface 104 of the cell cover 96. For example as illustrated in FIG. 5, the support cell 14A includes the envelope 34A, which is surrounded by the cell cover 96A. The exterior surface 100A of the envelope 34A is free to slide along the interior surface 102A of the cell cover 96A. This sliding movement is not transmitted to the stationary exterior surface 104A of the cell cover 96A. The stationary exterior surface 104A is located on the side of the outer cover 22 (FIG. 11) on which the patient 56 is lying, so that the sliding movement of the envelope 34A is not transmitted to the patient. Therefore, the cell covers 96 of the sleeve apparatus 16 prevent frictional shear force abrasion damage to the skin of the patient 56.

Figure 7:
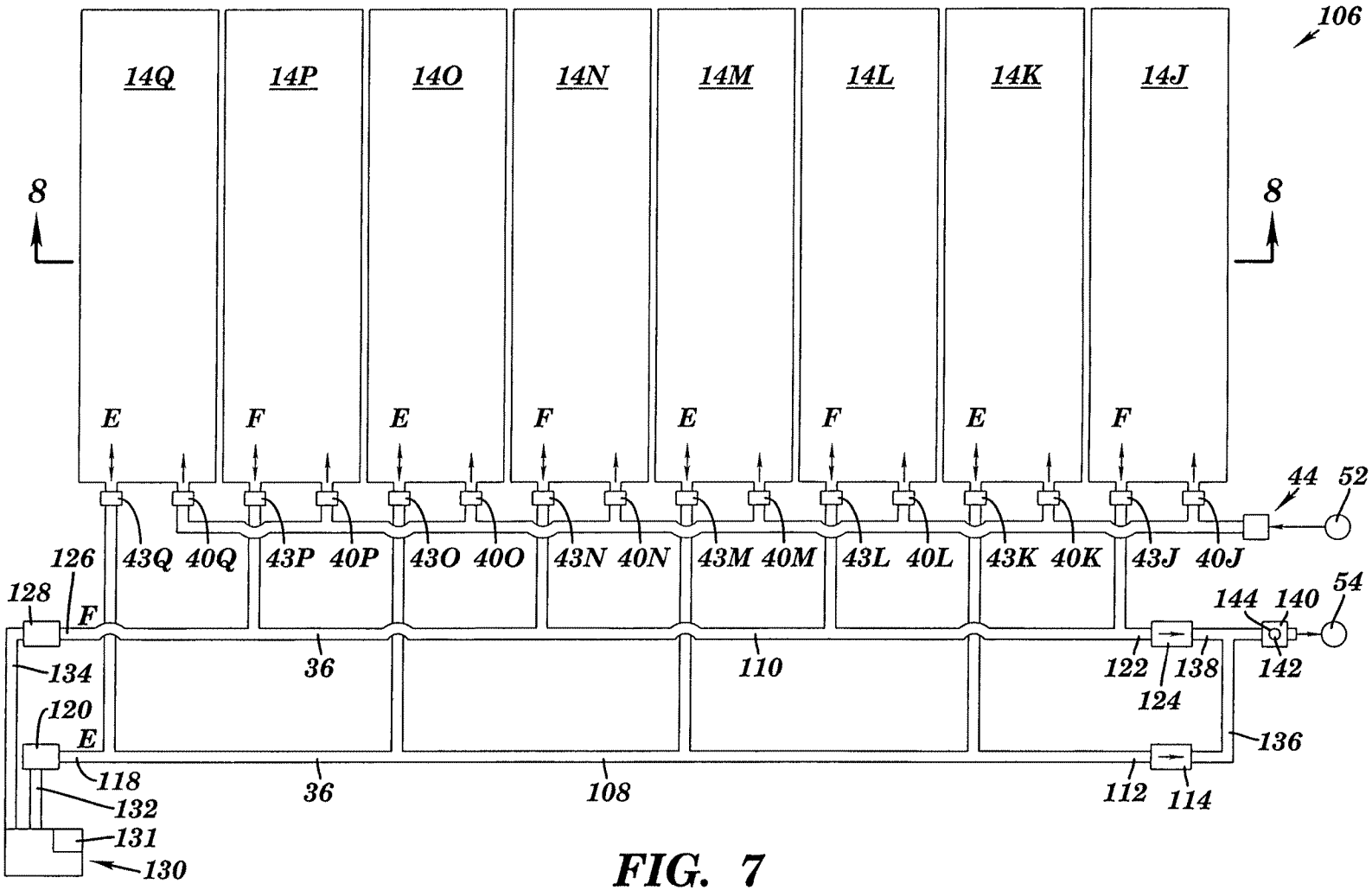
FIG. 7 illustrates a plan view of another embodiment of the support system apparatus including an alternating pressure system.

Another embodiment of a support system apparatus 106, provides an additional alternating pressure system 130 for providing alternating supply pressure to a plurality of zones "E" and "F" as illustrated in FIG. 7. The alternating pressure system 130 can include any means for supplying the fluid 36 under pressure including a pump, compressor, etc. Also, included in the alternating pressure system 130 is any means such as a valve (not shown) for periodically switching the pressurized fluid 36 between conduit 132 and 134. Each support zone "E" and "F," comprises at least one support cell 14. Each support cell 14 includes at least one intake valve 40 and at least one port 43. Each intake valve 40 includes a check valve (not shown) allowing fluid 36 to flow into the support cell 14, while preventing fluid 36 from flowing out of the support cell 14. Each port 43 allows unimpeded fluid 36 flow into or out of the support cell 14. As illustrated in FIG. 7, each intake valve 40J-40Q is connected to the intake control system 44.

The ports 43Q, 430, 43M, and 43K in zone "E" are connected to conduit or manifold 108. The ports 43J, 43L, 43N, and 43P in zone "F" are connected to conduit or manifold 110. A first end 112 of conduit 108 is connected to a check valve 114, and a second end 118 of conduit 108 is connected to a shut off valve 120. A first end 122 of conduit 110 is connected to a check valve 124, and a second end 126 of the conduit 110 is connected to a shut off valve 128. Conduit 132 connects the shut off valve 120 with the alternating pressure system 130. Conduit 134 connects the shut off valve 128 with the alternating pressure system 130. Conduits 136 and 138 connect the check valve 114 and the check valve 124 with the exhaust control system 140.

The shut off valve 120 can be a "quick disconnect" type that allows fluid 36 to flow through the shut off valve 120 when the conduit 132 is connected, and prevents any flow of the fluid 36 flow when the conduit 132 is disconnected. The shut off valve 128 can also be a "quick disconnect" type that allows fluid 36 to flow through the shut off valve 128 when the conduit 134 is connected, and prevents any flow of the fluid 36 when the conduit 134 is disconnected. Check valve 114 allows fluid 36 to flow from conduit 108 into conduit 136, and prevents fluid 36 from flowing from conduits 136 and 138 into conduit 108. Check valve 124 allows fluid 36 to flow from conduit 110 into conduit 138, and prevents fluid 36 from flowing from conduits 138 and 136 into conduit 110. The exhaust control system 140 includes a pressure relief valve 142 similar to the pressure relief valves described above.

When shut off valves 120 and 128 are closed, the pressure relief valve 142 maintains the pressure of the fluid 36 below a selected level in the conduits 108 and 110. Each intake valve 40J-40Q allows fluid 36 to flow into each support cell 14J-14Q, respectively, while preventing fluid 36 from flowing out of each support cell 14J-14Q, respectively, (FIG. 7). Each intake valve 40J-40Q is connected to the intake control system 44, which is connected to the fluid supply reservoir 52. Generally, the fluid 36 included in the fluid supply reservoir 52 is atmospheric air, however, any other suitable fluids can be used. Conduits 108 and 110 are connected through ports 43J-43Q to the zones "E" and "F." Therefore, the pressure relief valve 142 maintains the pressure of the fluid 36 below a selected level in zones "E" and "F." A rotatable knob 144 or other adjusting system included in the pressure relief valve 142 allows a user to set the maximum pressure of the fluid 36 in the zones "E" and "F." The pressure relief valve 142 is connected to the fluid exhaust reservoir 54. When using atmospheric air, and with the shut off valves 120 and 128 closed, the support system apparatus 106 is self-inflating and self-adjusting.

The alternating pressure system 130 supplies alternating high and low pressure fluid 36 to conduits 108 and 110. When conduit 132 is connected to shut off valve 120, and conduit 134 is connected to shut off valve 128, the alternating pressure is supplied to conduits 108 and 110. The conduits 108 and 110 supply the alternating fluid 36 pressure to zones "E" and "F."

Figure 8:
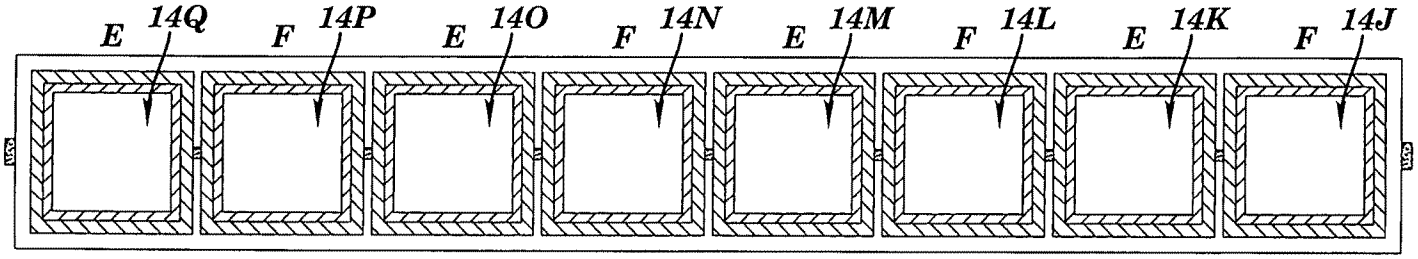
FIG. 8 illustrates a cross-sectional view of the support system apparatus taken along the line 8-8 of FIG. 7.
Figure 9:
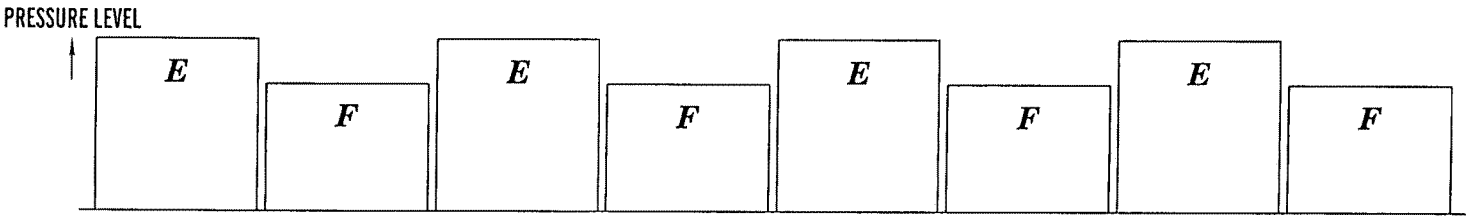
FIG. 9 illustrates a first pressure distribution pattern provided by the alternating pressure system in the plurality of support cells of FIG. 8.

For example, a high pressure fluid 36 may be supplied to the conduit 108 from the alternating pressure system 130, and a low pressure fluid 36 may be supplied to conduit 110, creating a high fluid 36 pressure in zone "E" and a low fluid 36 pressure in zone "F." The fluid 36 flows through check valve 114 to conduit 136 and 138, but is prevented by check valve 124 from flowing into conduit 110. The fluid 36 flow provided by the alternating pressure system 130 is much higher than the flow passing out through the pressure relief valve 142, so that the high pressure fluid 36 fills the zone "E" support cells 14K, 14M, 140, and 14Q as illustrated in FIG. 8. FIG. 9 illustrates the pressure levels in the support cells in zones "E" and "F". For this condition, the support cells 14 in zone "E" rise under the patient 56 and the support cells 14 in zone "F" lower under the patient 56.

Figure 10:
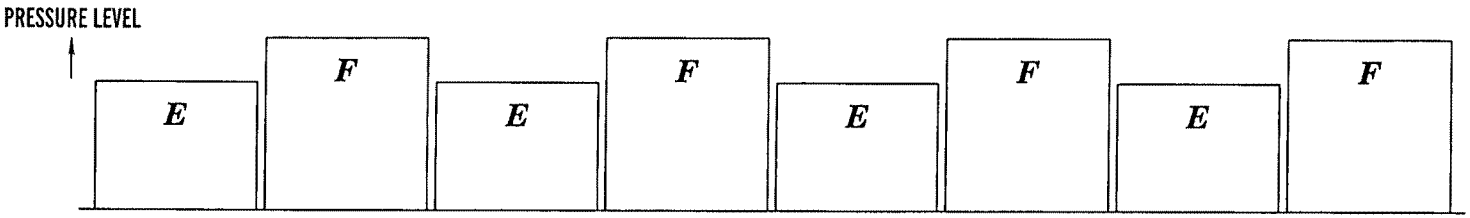
FIG. 10 illustrates a second pressure distribution pattern provided by the alternating pressure system in the plurality of support cells of FIG. 8.

Next, a high fluid 36 pressure is supplied to conduit 110 and a low fluid 36 pressure is supplied to conduit 108, forcing a high pressure fluid 36 into zone "F" and a low pressure fluid 36 into zone "E". The fluid 36 flows through check valve 124 to conduit 138 and 136, but is prevented by check valve 114 from flowing back into the conduit 108. The fluid 36 flow provided by the alternating pressure system 130 is much higher than the flow passing out through the pressure relief valve 142, so that the high pressure fluid 36 fills the zone "F" support cells 14J, 14L, 14N, and 14P. FIG. 10 illustrates the pressure levels in the support cells 14 in zones "E" and "F." For this condition, the zone "F" support cells 14 rise under the patient 56 and the zone "E" support cells 14 lower under the patient 56.

The alternating rising and lowering of the support cells 14 in the zones "E" and "F" under the patient 56, provides beneficial movement of the skeleton and tissue in the patient 56. The movement helps stimulate circulation and lymph fluid movement in the patient 56.

The alternating pressure system 130 includes a computerized control system 131 that is programmed to supply alternating pressures to a plurality of support cells 14 in any sequence that is desired by the user.

Figure 16:
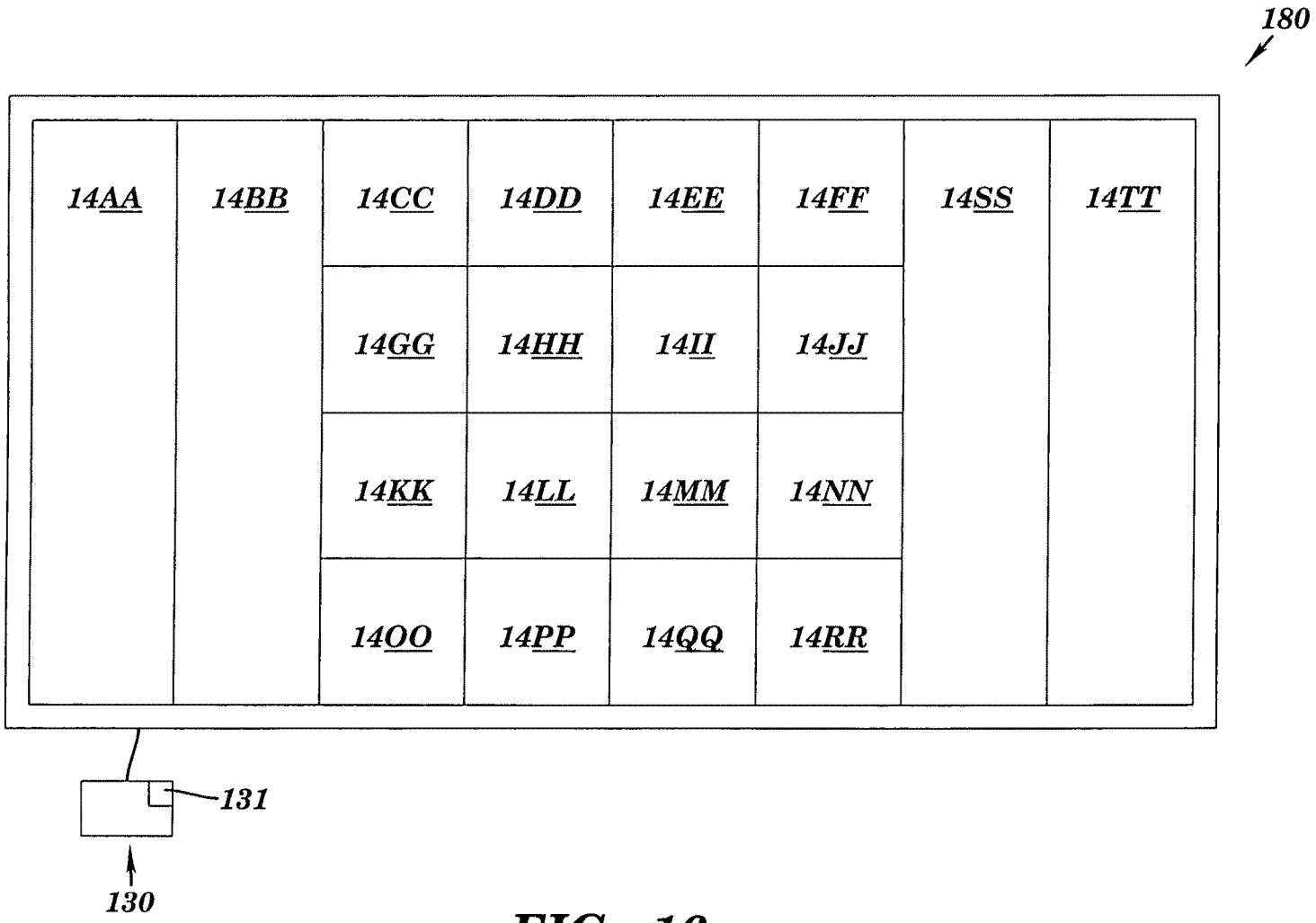
FIG. 16 illustrates a plan view of another embodiment of a cushion device with alternating pressure support cells.

Another embodiment of a support system apparatus 180 with a plurality of support cells 14 is illustrated in FIG. 16. This embodiment shows another example of the shape of support cells 14AA-14SS. The support cells 14 can be inter-connected in a manner similar to the support system apparatus 12 and the support system apparatus 106 to provide the support system apparatus 180 with self-inflating, self-adjusting, zoned pressure control, and alternating pressure support and movement to a person lying on the support system apparatus 180. The computerized control system 131 included in the alternating pressure system 130 may be programmed to supply alternating pressures to the plurality of the support cells 14AA-14SS in any sequence that is desired by the user.

Figure 11:
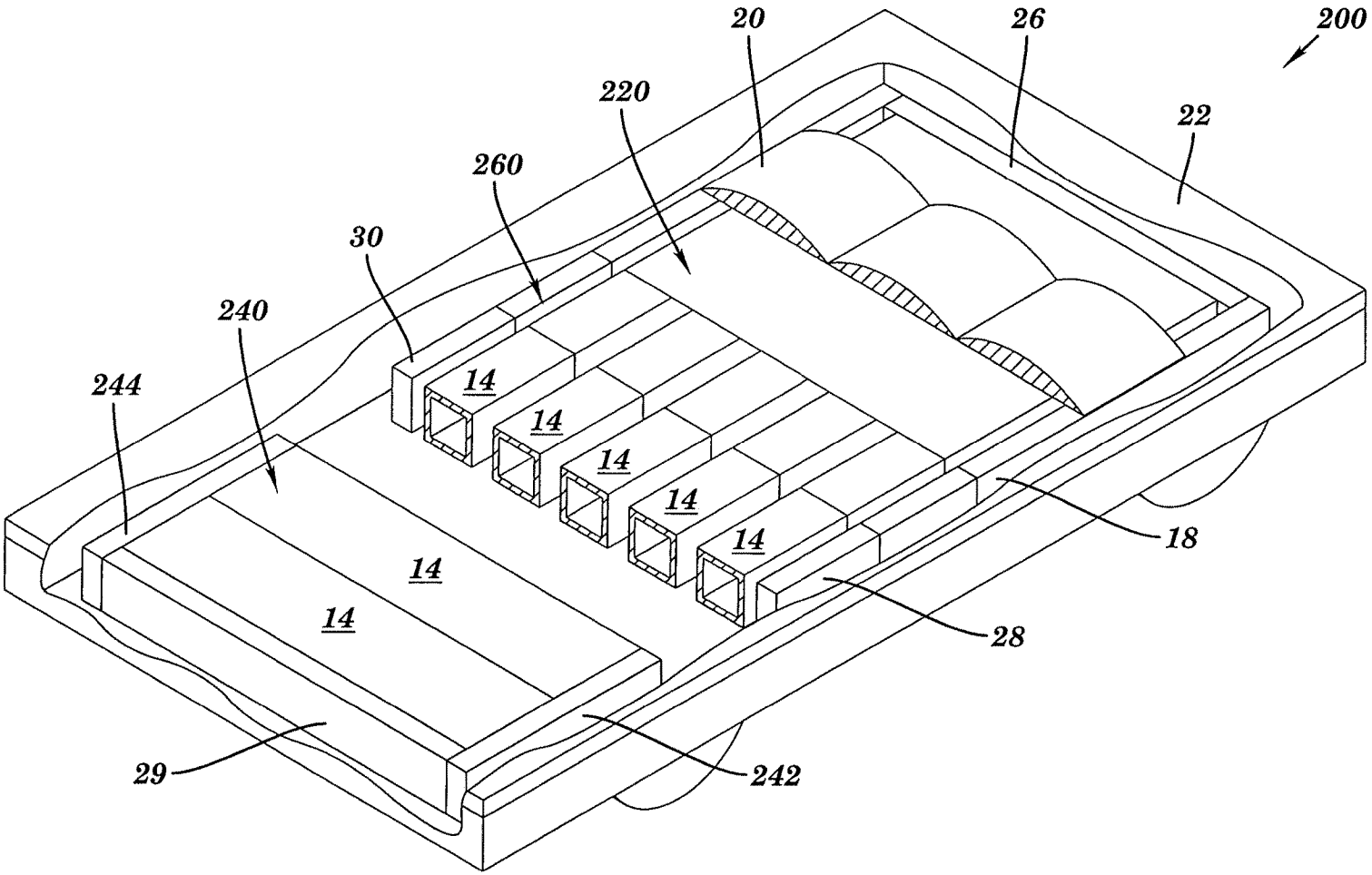
FIG. 11 illustrates a cut-away perspective view of a mattress cushioning device.

FIG. 11 illustrates a cut-away perspective view of a mattress cushioning device 200. The mattress cushioning device 200 includes a torso support system 220, a heel support system 240, and a sleeve apparatus 260, the jacket 18, the topper cushion 20, and the outer cover 22. The torso support system apparatus 220 includes a plurality of support cells 14, the side wall 28, the end wall 26, and the side wall 30. The side walls 28 and 30 and the end wall 26 are formed from a resilient material. The sleeve apparatus 260 includes cell covers 96. Each cell cover 96 surrounds a support cell 14 to prevent sliding and frictional motion to be transmitted to the patient 56. The support cells 14 provide self-inflating and self-adjusting pressure support to the torso region of a patient 56 resting on the support system apparatus 220. The support cells 14 extend in a longitudinal direction of the mattress cushioning device 200. Also, alternating pressure can be applied to the individual support cells 14 under the patient 56 to provide therapeutic movement to the body of the patient 56.

The heel support system apparatus 240 includes a plurality of support cells 14, the end wall 29, a side wall 242, and a side wall 244. The heel support system 240 provides support for the heel area of a patient 56. The support cells 14 extend in a transverse direction on the mattress cushioning device 200.

The jacket 18 surrounds the torso support system apparatus 220 and the heel support system apparatus 240. The topper cushion 20 lies on top of the jacket 18 and provides further cushioning and comfort to the patient 56. The topper cushion 20 can be composed of any resilient material, for example, foam, down feathers, an inflatable air cushion, etc.

Figure 12:
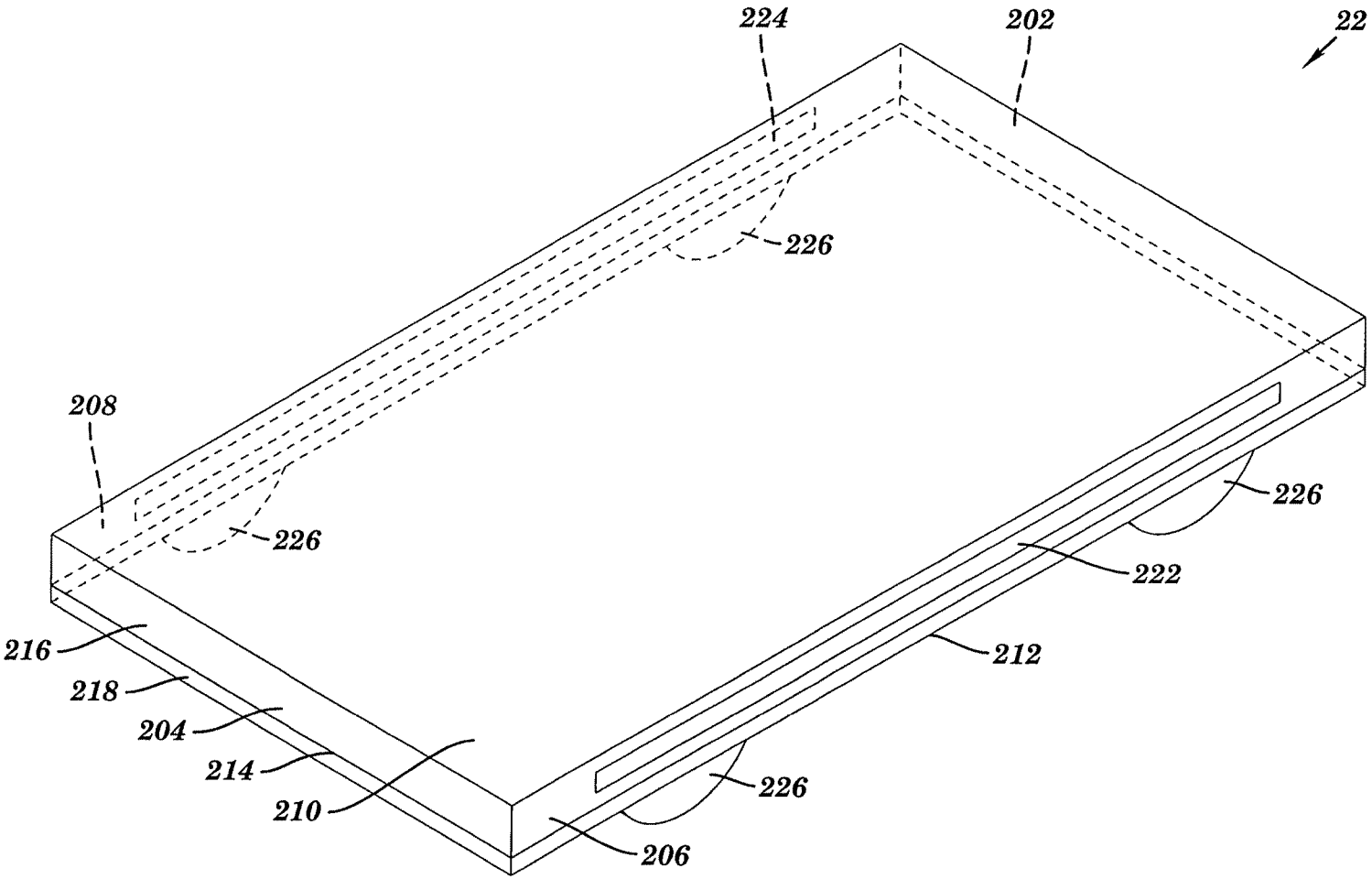
FIG. 12 illustrates a perspective view of the mattress cushioning device with an outer cover.

The outer cover 22 is illustrated in FIGS. 11 and 12. The outer cover 22 of the mattress cushioning device 200 provides a low friction and low shear surface further protecting the patient 56 from frictional tissue damage. Additionally, the outer cover 22 provides a waterproof and stain resistant surface. For medical uses the outer cover 22 can be made from an anti-microbial type material. The outer cover 22 includes end walls 202 and 204, side walls 206 and 208, a top wall 210 and a bottom wall 212. A closure 214 joins an upper portion 216 to a lower portion 218 of the outer cover 22. The closure 214 may comprise, for example, a zipper, snaps, hook and eye fasteners, etc. The side walls 206 and 208 can include stretchable panels 222 and 224 that allows the outer cover 22 to expand and contract as the support cells 14 rise and fall within the outer cover 22. The displacement of the support cells 14 is accommodated by the stretchable panels 222 and 224 so that stretching of the top wall 210 is prevented. Thus, the top wall does not transmit shear forces to the patient 56 resting on the top wall 210. Flexible handles 226 can be attached to the outer cover 22 to allow a user to grasp and move the mattress cushioning device 200.

Figure 15:
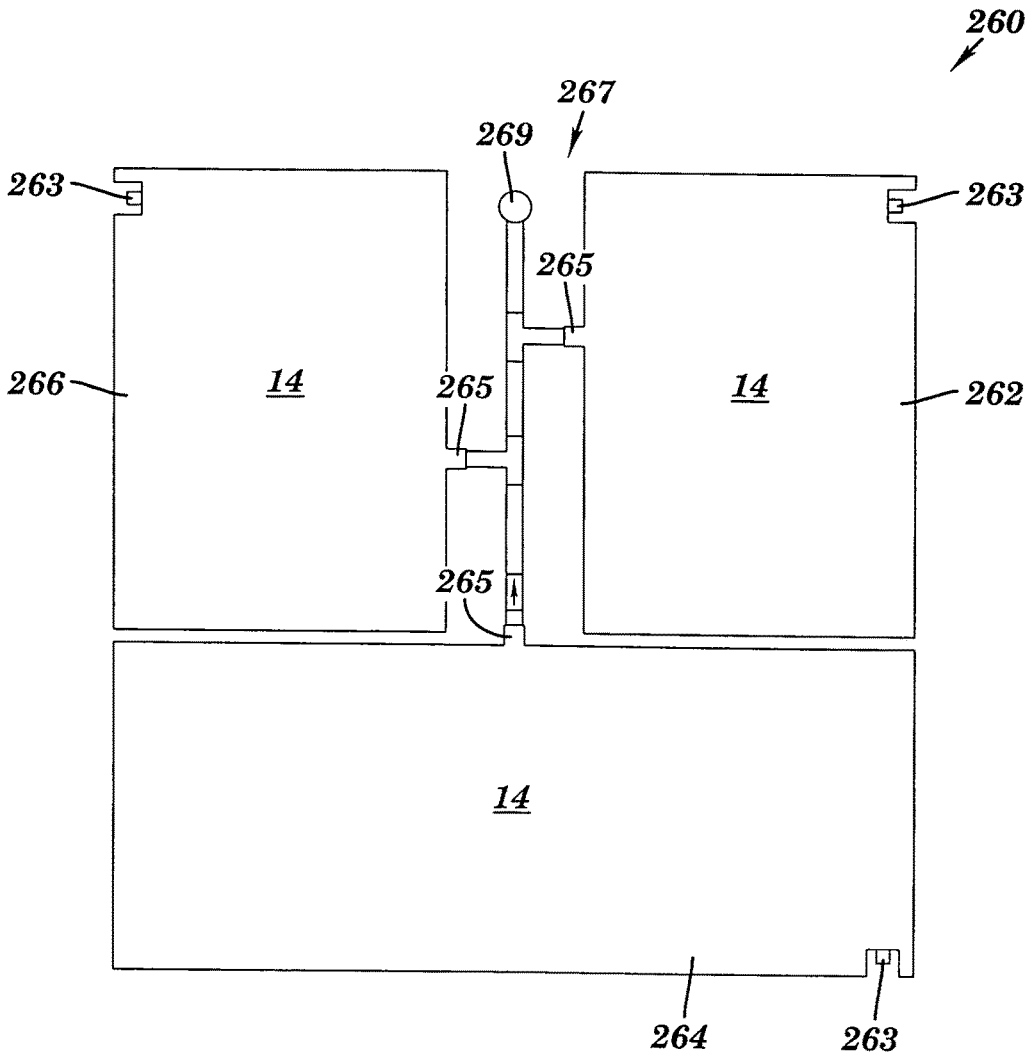
FIG. 15 illustrates a perspective view of a chair seat cushioning device.

An embodiment of a seat cushioning device 260 in accordance with the present invention is illustrated in FIG. 15. The seat cushioning device 260 includes three supporting sections 262, 264, and 266. Each section 262, 264, and 266 includes at least one support cell 14. The support cells 14 can be inter-connected in a manner similar to the support system apparatus 12, the support system apparatus 180, and the support system apparatus 106 to provide the seat cushioning device 260 with self-inflating, self-adjusting, zoned pressure control, and alternating pressure support and movement to a person sitting on the seat cushioning device 260. For example, the supporting sections 262, 264, and 266 may each include an intake valve 263 and an exhaust valve 265. The exhaust valves 265 are interconnected by an exhaust control system 267 having a controllable pressure relief valve 269. As in previous embodiments of the present invention, the pressure relief valve 269 is provided to control the maximum pressure level of the fluid in each of the supporting sections 262, 264, and 266.

Figure 19:
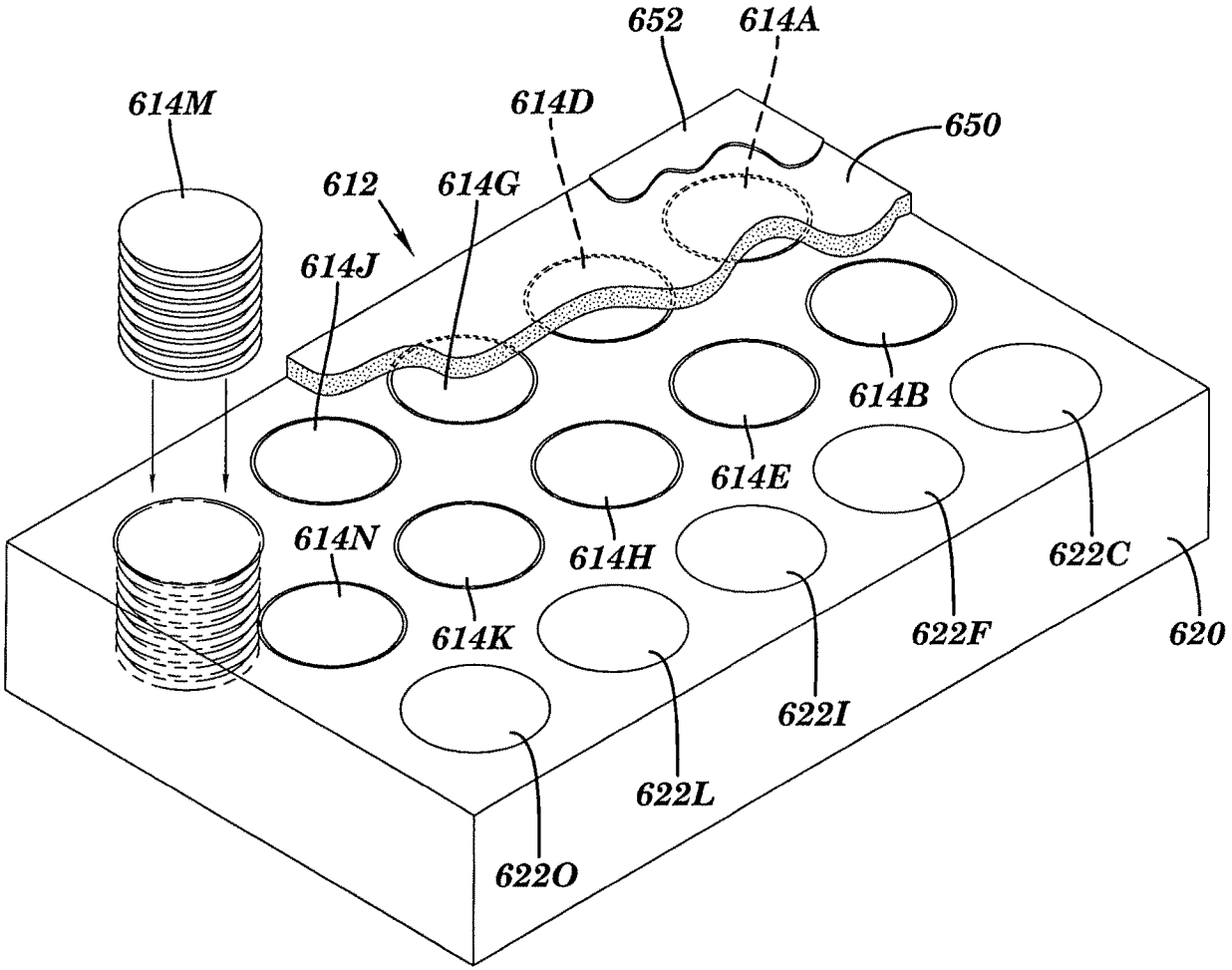
FIG. 19 illustrates a perspective view of a cushioning device including spring biased fluid cells in accordance with the present invention.

Another embodiment of a support system apparatus 612 is illustrated in FIG. 19, which includes at least one support cell, or fluid cell 614, that fits into a holding mechanism or casing 620, a topper cushion 650 positioned above the cells to provide further cushioning, and an outer cover 652. The embodiment shown in FIG. 19 shows another example of the shape of support cells 614A-614O. The support cells 614 can be interconnected in a manner similar to the support system apparatus 12 and the support system apparatus 106 to provide the support system apparatus 612 with self-inflating, self-adjusting, zoned pressure control, and alternating pressure support and movement to a person lying on the support system apparatus 612. The computerized control system 131 included in the alternating pressure system 130 may be programmed to supply alternating pressures to the plurality of the support cells 614A-614O in any sequence that is desired by the user.

Figure 23:
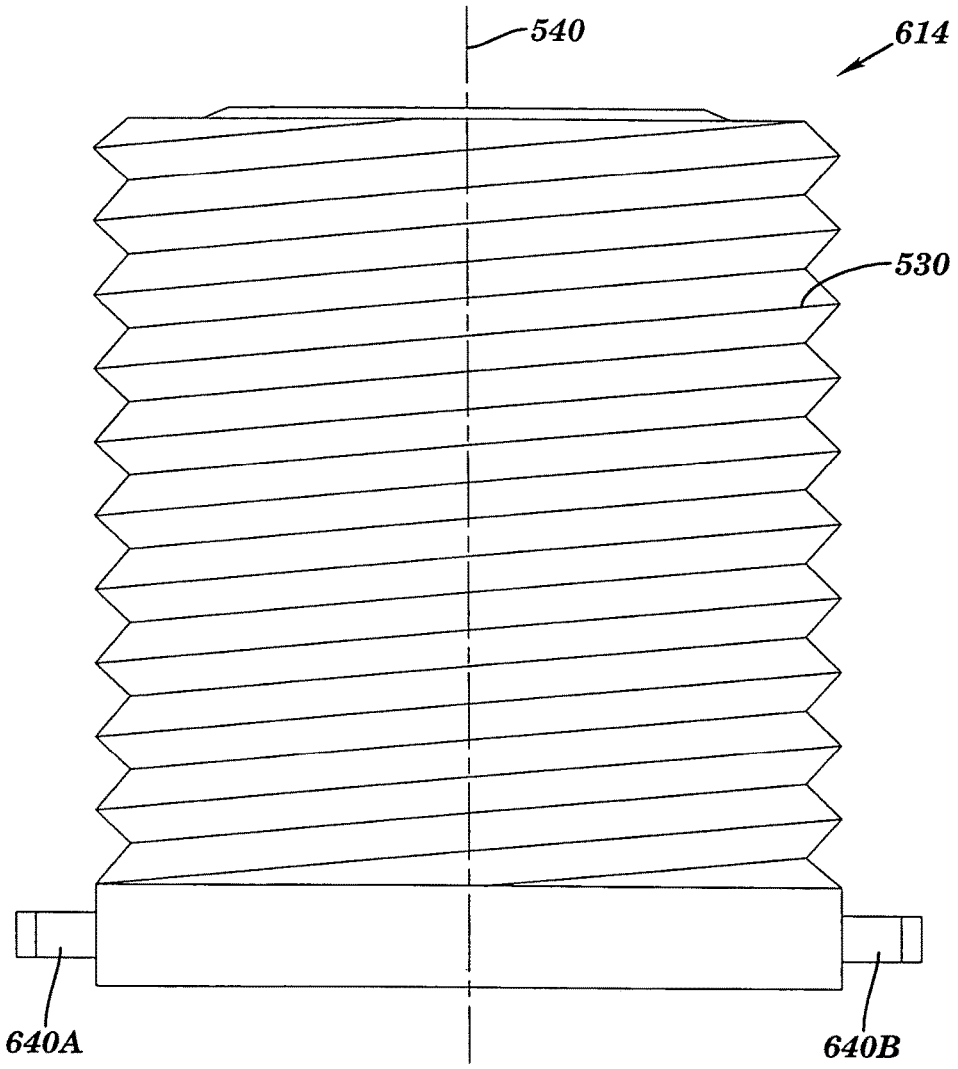
FIG. 23 illustrates a side view of a fluid cell including the spring bias construction.

The support system apparatus 612 includes at least one support cell or fluid cell 614 for providing support of a patient 56. The fluid cell 614 may be referred to as a pod. The greater the number of fluid cells 614, the more responsive the apparatus will be to a weight or load. FIG. 23 illustrates side view of a typical fluid cell 614 having a helical pattern 530 on its outer construct, a vertical rotational axis 540, and a plurality of ports, 640A and 640B. The fluid cells 614 may have a single helical pattern or a double helical pattern on the outer construct. However, the fluid cell 614 may also be any fluid cell which has a spring bias which effects the reformation of the fluid cell such that the fluid cell collapses when loaded with a load having a force which is greater than the sum of the forces within the fluid cell, including the pressure of the fluid inside the fluid cell multiplied by the area of the fluid cell supporting the load, plus the reforming force of the fluid cell, and said fluid cell reforms when said load is reduced to a load having a force which is less than the sum of the forces within the fluid cell and the reforming force of the fluid cell. In other words, once the fluid cell 614 is compressed with the weight of a person or article, the fluid cell 614 exerts a reforming force so as to reform when the weight is reduced. The application of an external load on the fluid cell 614 causes the fluid cell 614 to deform into a compressed form. The fluid cell 614 provides a reforming force which causes the fluid cell 614 to return to its original form when the external load is removed from the fluid cell 614 such that the fluid cell is self-inflating.

The fluid cell 614 is formed from a resilient material that can contain a fluid such as air, water, or nitrogen. The fluid cell 614 may be formed from plastic resin or any elastomeric material that may be compression molded. However, the fluid cell 614 could also be a metal coiled spring 500 (FIG. 17) which is surrounded by a resilient material as a surface cover 502. The surface cover 502 may be fabric, waterproof material, rubber, plastic, moisture wicking material, microfiber, or any material which would resiliently or yieldingly cover the spring 500 and be resiliently or yieldingly supported by the spring 500 while containing a fluid. The fluid cell 614 could also be in the form of a bellows 520 (FIG. 18) which is formed from a pliable resilient material such as plastic and filled with fluid such as air.

Both fluid cell movement and the firmness and softness of the fluid cells are determined by the properties of the fluid cell 614, and the pressure level at which the controllable pressure relief valve 62 is set. For example, variables such as base material height, ILD (Incidence of Load Deflection), density of the fluid cell material, air pressure, fluid cell height, air flow control, air sound control, direction of air flow, and speed of air movement all affect the response of the fluid cell to a force. In addition, the height of the fluid cell, the diameter of the fluid cell, the wall thickness of the fluid cell, the type of resin used to form the fluid cell, and the pitch or angle of the helix coupled with the OD and ID radius of the helix contribute to controlling the firmness of the fluid cells 614 as shown in FIGS. 18, 19, 20*a* and 23. The fluid cells 614 can contain air, or any suitable fluid (e.g., air, nitrogen, water, etc.).

Figure 24:
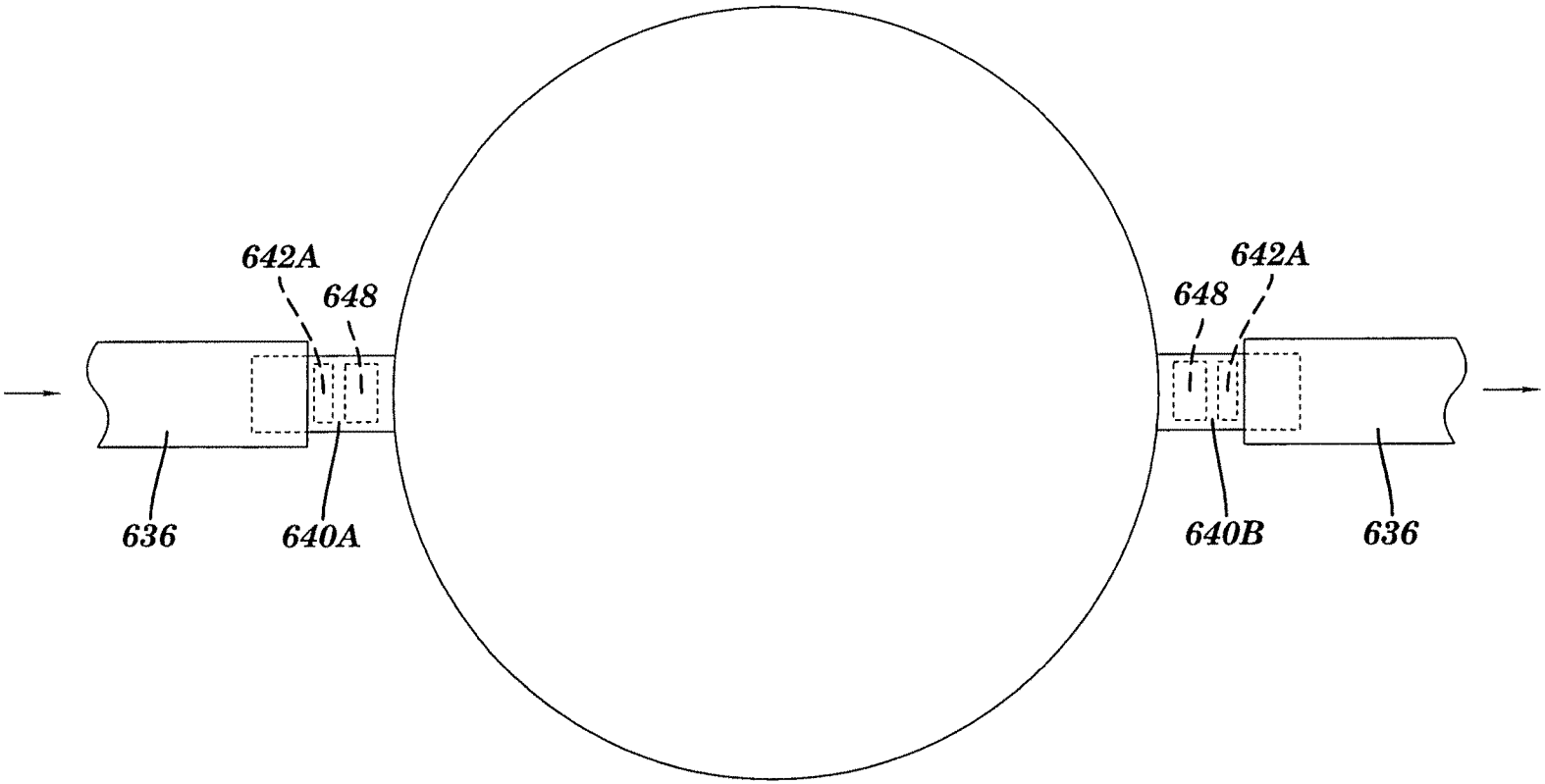
FIG. 24 illustrates a cross-sectional view of an embodiment of a fluid cell having a spring bias including sound control battens.

The embodiment in FIG. 23 shows a cylindrical fluid cell or pod 614 having a double or twin helix pattern 530. As shown in FIGS. 18, 19, 20*a*, 21 and 23, the helix is formed without a coiled metal spring in contrast to the embodiment shown in FIG. 17. The double helix design 530 controls stability and deflection of the fluid cell 614 such that the fluid cell 614 closely maintains its alignment parallel to its vertical rotational axis 540 during compression and reformation. FIGS. 23 and 24 show that each fluid cell 614 has a plurality of ports 640. There may be an intake port 640A and an exhaust port 640B. The intake port 640A may contain an intake check valve 642A allowing fluid 36 to flow into the support cell 614, while preventing fluid 36 from flowing out of the support cell 614. Likewise, each exhaust port 640B may include an exhaust check valve 642B allowing fluid to flow out of the fluid cell while preventing fluid 36 from flowing back into the fluid cell 614.

Air sound control is achieved using sound control battens 648, as shown in FIG. 24, in either the ports 640 or the conduits extending from the fluid cells 614. FIG. 24 shows that a sound control batten 648 in may be included in the intake and/or exhaust ports 640A and 640B, or in the conduit 363 operatively connected to the fluid cells 614. The sound control batten 648 is for reducing the sound during intake and exhaust of the fluid cell 614. The sound control batten 648 can be reticulated foam, a variegated surface, or any material that would fit within a port, conduit, or connection extending from the port, and function to reduce the sound of air movement during intake and exhaust. The variegated surface allows fluid to flow through the variegated surface to slow the air flow down and thereby reduce sound. The sound control batten 648 may be formed from a flexible or rigid material. A sound control batten 648 may also be included in the embodiments shown in FIGS. 1, 3, 4, 7, and 16.

An example of a support system apparatus 612 for a mattress includes a plurality of fluid cells 614A, 614B, 614C, 614D, 614E, 614F, 614G, 614H, 614I, 614J, 614K, 614L, 614M, 614N, and 614O as is illustrated in FIG. 19. The fluid cells 614 are held together by a base housing, or casing, 620, which is adapted to receive or accept the fluid cells 614. The casing 620 is a holding mechanism that controls air pod movement about the surface. The casing 620 may be composed of air or foam or other porous or non-porous materials. The casing 620 may be a foam casing, plastic webbing, or any configuration that affixes the fluid cells 614 together to form a mattress, cushion, or support apparatus. FIG. 19 shows a casing 620 that is a foam casing including bays 622 for receiving the fluid cells 614. The casing 620 functions as a fluid cell receiver and is a means of affixing the fluid cells together to form a mattress construct. The casing 620 provides fluid cell stability by utilizing variable heights (H) of the base, by altering the ILD, density and air pressure of the mass of the base housing (not limited to foam), and the relationship of base material to the number of fluid cells in a given area. The casing 620 supports, houses, and prevents movement of the fluid cells 614 and the air supply system 630.

Figure 20A:
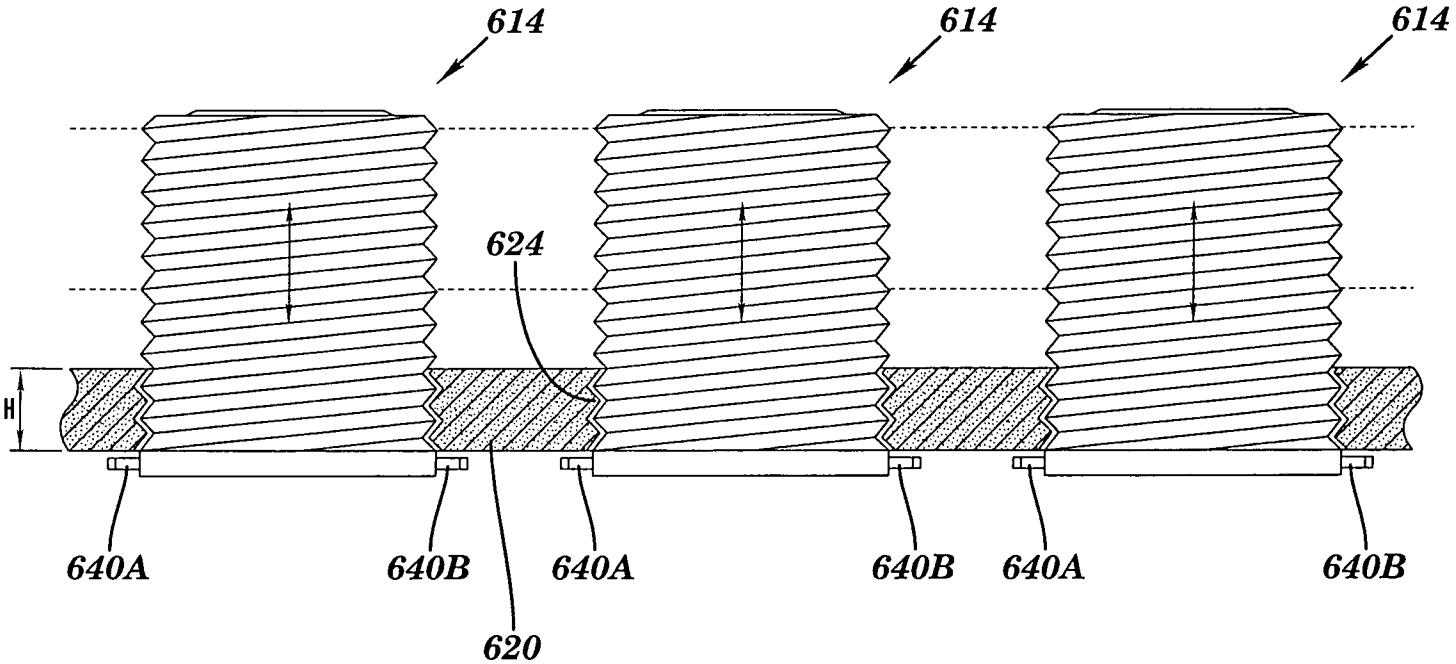
FIG. 20A illustrates a side view of an embodiment of the casing with spring biased fluid cells installed therein.
Figure 20B:
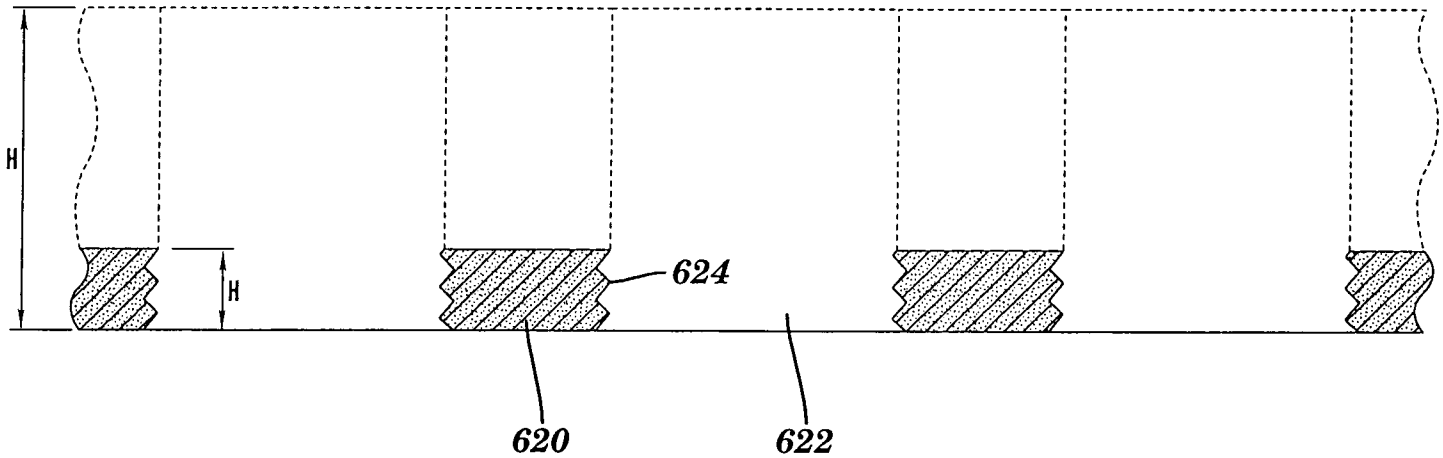
FIG. 20B illustrates a side view of an embodiment of the casing.

FIG. 20A shows a side view of an embodiment of a casing 620 with the fluid cells 614 installed therein, and FIG. 20B shows a side view of a casing 620 without the fluid cells 614 installed therein. Dotted lines indicate that the casing 620 in this foam embodiment may be various heights (H), which would affect the depth of the bays 622. For example, as shown in FIG. 20A, the casing may be a height (H) which is a small portion of the height of the fluid cells 614. Conversely, the casing 620 can extend vertically up to, or near to, the same height as the fluid cells 614. In order to hold the fluid cell 614 within the casing, the casing can include threaded constructs 624 in the openings or bays 622 adapted to receive the threaded (i.e., helical) exterior of the fluid cells 614.

Figure 21:
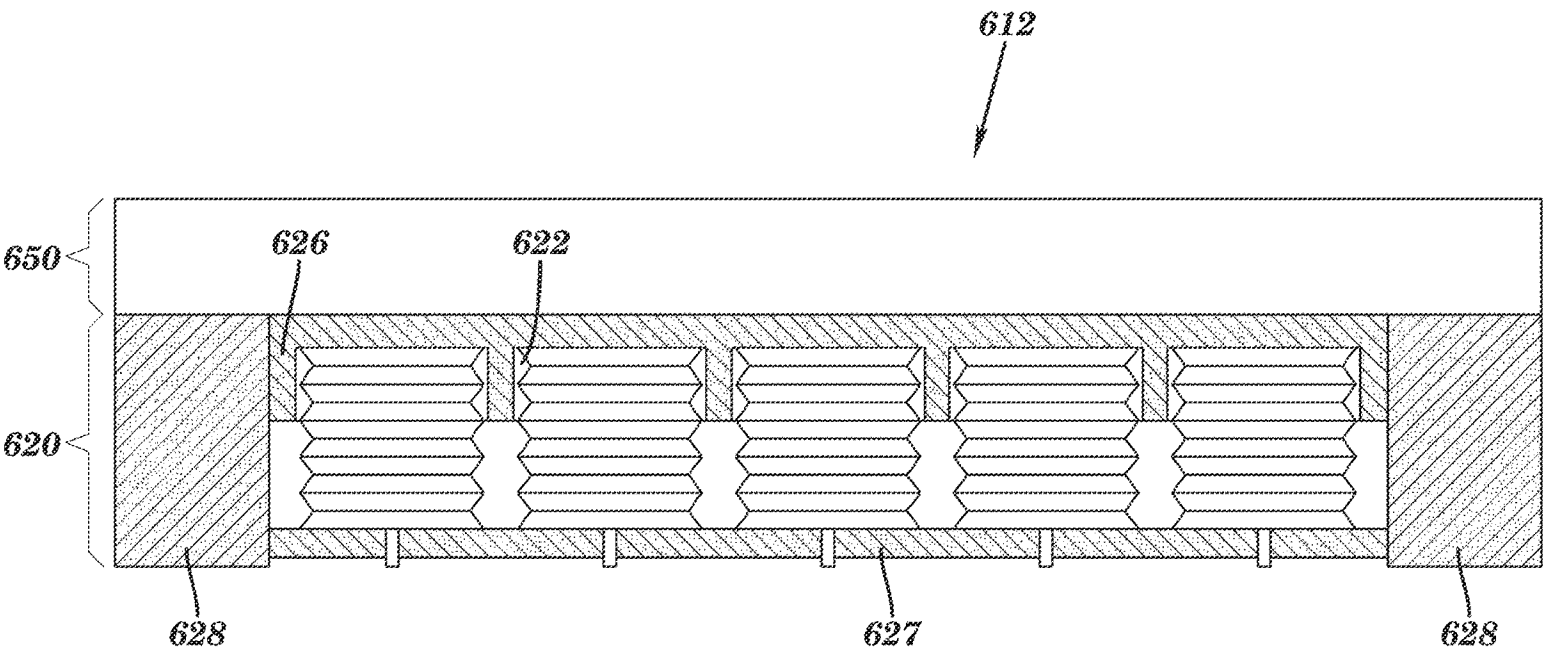
FIG. 21 illustrates a side view of an embodiment of the casing with spring biased fluid cells installed therein.

FIG. 21 shows another embodiment of a casing 620 having a plurality of pads 621. At least one of the pads, in this embodiment the top pad, or first pad, 626, is adapted to accept the plurality of fluid cells. For example, as shown in FIG. 21, the pad includes openings or bays 622 that generally conform to the shape of the fluid cells 614 and secure the fluid cells 614 during use of the apparatus 612. The casing 620 may have one or more side walls 628, and a bottom pad, or second pad, 627.

Figure 22:
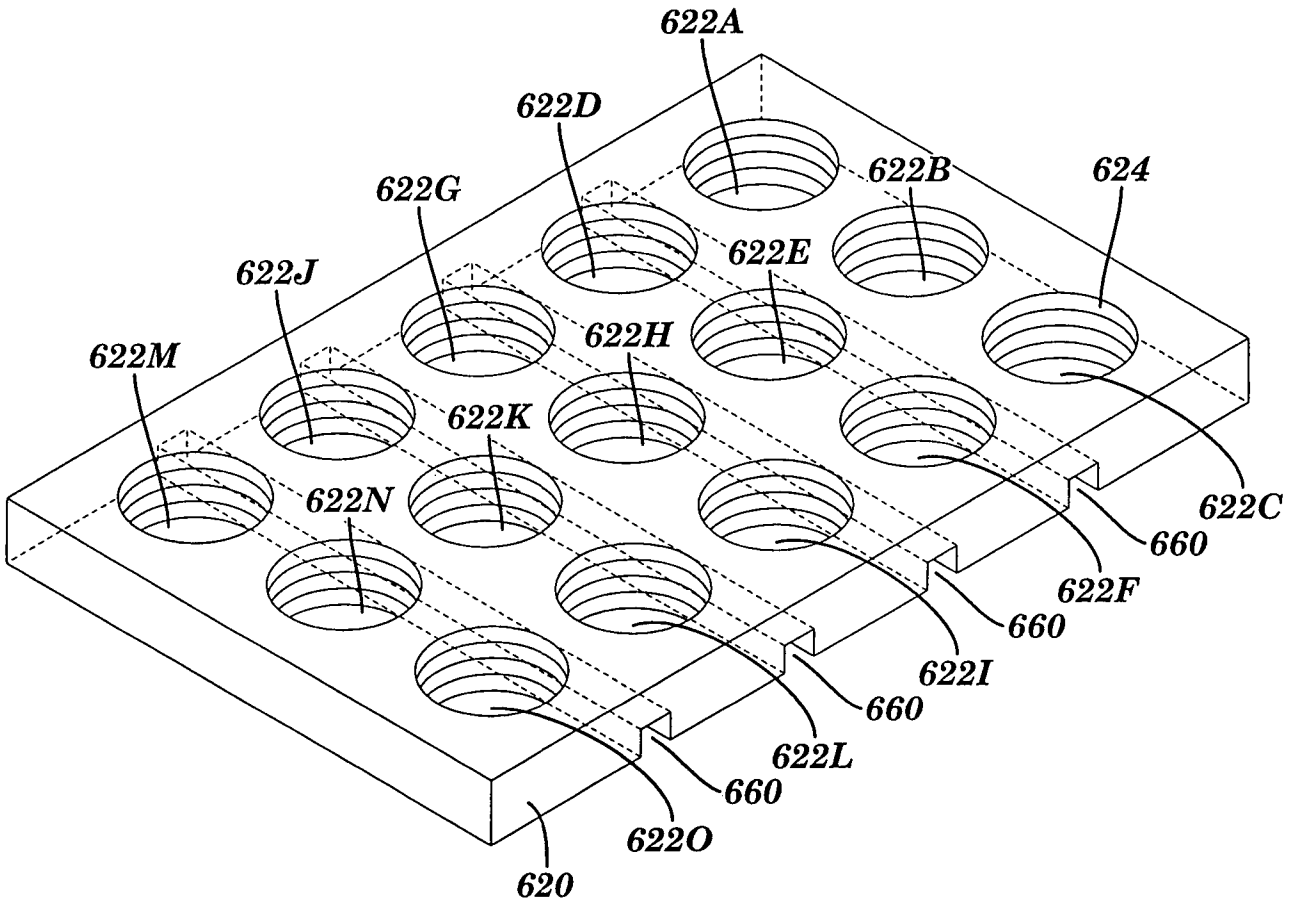
FIG. 22 illustrates a perspective view of a casing without the air pods installed.

FIG. 22 shows a top perspective view of a casing 620 without the fluid cells installed and illustrates the bays 622A-6220 for receiving the fluid cells 614. The casing 620 may include paths 660 between the bays 622 for receiving the conduits which interconnect the fluid cells 614 (FIG. 22). The paths 660 can be openings or slits in the casing 620 and may be cut or molded into the base housing 620.

FIG. 19 shows that the support system apparatus has a topper cushion 650 and an outer cover 652. The topper cushion 650 rests above of the fluid cells 614 and casing 620 to provide further cushioning. The topper cushion 650 may be formed from a layered fiber filled material or any other suitable material that provides cushioning such as foam, wool, or a moisture wicking material. The casing 620, fluid cells 614, and topper cushion 650 are contained by an outer cover 652 which may have a low friction and low shear surface for further protecting the patient from frictional tissue damage. Additionally, the outer cover 652 provides a waterproof and stain resistant surface. The outer cover 652 can be expandable, waterproof, or moisture wicking. The outer cover 652 may include one or more stretchable panels to provide expansion space. For medical uses, the outer cover 652 can be made from an anti-microbial type material.

The foregoing description of the present invention has been presented for purposes of illustration and description. It is not intended to be exhaustive or to limit the invention to the precise form disclosed, and many modifications and variations are possible in light of the above teaching. For example, the cushioning device of the present invention is suitable for providing self-inflating, self-adjusting, zoned pressure control, and alternating pressure support to any supported body. Also, the cushioning device of the present invention is suitable for any application where low interface pressure is required between the cushioning device and the surface of the body being supported. Such modifications and variations that may be apparent to a person skilled in the art are intended to be included within the scope of this invention as defined by the accompanying claims.

I claim:

1. A support surface comprising:

a plurality of self-inflating fluid cells, wherein each said self-inflating fluid cell has a spring bias to reform said self-inflating fluid cell and at least one port; and a casing adapted to receive said plurality of self-inflating fluid cells, wherein said casing affixes said self-inflating fluid cells together to form a mattress construct, further comprising a sound control device in line with said port and operatively attached for reducing the sound of fluid during intake and exhaust of the self-inflating fluid cell, said sound control device having a variegated surface which allows fluid to flow through the variegated surface to slow the air flow down and thereby reduce sound.

2. The support apparatus of claim 1, wherein the sound control device comprises a batten of reticulated foam.

3. The support apparatus of claim 1, wherein the sound control device comprises a batten.

4. The support apparatus of claim 1, wherein the sound control batten is selected from the group consisting of flexible material and rigid material.

* * * * *